US011076650B2

(12) United States Patent
Tussey

(10) Patent No.: US 11,076,650 B2
(45) Date of Patent: Aug. 3, 2021

(54) HEAD HAIR WRAP CAP FOR COVERING OR PROTECTING THE HEAD AND / OR HAIR

(71) Applicant: Julie A. Tussey, New York, NY (US)

(72) Inventor: Julie A. Tussey, New York, NY (US)

( * ) Notice: Subject to any disclaimer, the term of this patent is extended or adjusted under 35 U.S.C. 154(b) by 169 days.

(21) Appl. No.: 15/885,423

(22) Filed: Jan. 31, 2018

(65) Prior Publication Data

US 2019/0037944 A1 Feb. 7, 2019

Related U.S. Application Data

(63) Continuation-in-part of application No. 14/544,462, filed on Jan. 9, 2015, now Pat. No. 9,907,381.

(51) Int. Cl.

| | |
|---|---|
| ***A41D 23/00*** | (2006.01) |
| ***A42B 1/004*** | (2021.01) |
| ***A42B 1/008*** | (2021.01) |
| ***A45D 8/40*** | (2006.01) |
| ***A42B 1/18*** | (2006.01) |
| ***A42B 1/22*** | (2006.01) |

(Continued)

(52) U.S. Cl.

CPC ..... *A41D 23/00* (2013.01); *A42B 1/004* (2013.01); *A42B 1/008* (2013.01); *A42B 1/041* (2013.01); *A42B 1/12* (2013.01); *A42B 1/18* (2013.01); *A42B 1/22* (2013.01); *A45D 8/40* (2013.01)

(58) Field of Classification Search

CPC .. A42B 1/12; A42B 1/04; A42B 1/041; A45D 44/08; A45D 44/12; A41D 23/00; A41G 5/0093

See application file for complete search history.

(56) References Cited

U.S. PATENT DOCUMENTS

| | | | | |
|---|---|---|---|---|
| 2,211,184 A | | 3/1940 | Varell | 2/174 |
| 2,730,722 A | * | 1/1956 | Colangelo | A42B 1/004 2/202 |
| 3,268,913 A | | 8/1966 | Gettinger | 2/171 |

(Continued)

FOREIGN PATENT DOCUMENTS

GB 2296180 6/1996

OTHER PUBLICATIONS

"Turbie Twist", suber absorbent hair towel, found at http://www.turbietwist.com/.

(Continued)

*Primary Examiner* — Sally Haden

(74) *Attorney, Agent, or Firm* — Ernest D. Buff & Associates, LLC; Ernest D. Buff; Margaret A. La Croix

(57) ABSTRACT

A hair wrap envelopes the hair. The hair wrap comprises a cap portion, a pouch, and side walls. The cap portion has at least one attachment means. At least two elongated ties located on opposite sides of the side walls are adapted to be twisted for securing the wrap on the user's head. A material loop is located on a back base of the pouch to hold the ties in place. An attachment means located on a bottom edge of the pouch mates with the attachment means of the cap portion. A crown material loop located on the top section is adapted to hold the pouch after the pouch is twisted and lifted toward the top section. The pouch is adapted to be worn in a variety of styles, including to lay untwisted when the wrap is in an extended position, and twisted and lifted upward when the wrap is in a wrapped position.

20 Claims, 30 Drawing Sheets

(51) Int. Cl.
*A42B 1/041* (2021.01)
*A42B 1/12* (2006.01)

(56) References Cited

U.S. PATENT DOCUMENTS

| | | | | | |
|---|---|---|---|---|---|
| 3,555,565 | A * | 1/1971 | Zimmon | A42B 1/043 | 2/195.7 |
| 4,378,606 | A * | 4/1983 | Snowden | A42B 1/041 | 2/200.1 |
| 4,468,818 | A | 9/1984 | Flannery | 2/207 | |
| 4,671,302 | A * | 6/1987 | Hill | A45D 2/001 | 132/212 |
| 5,007,115 | A | 4/1991 | Denbow et al. | 2/208 | |
| 5,062,157 | A | 11/1991 | Muta | 2/171 | |
| 5,144,696 | A | 9/1992 | Kahl | 2/207 | |
| 5,203,358 | A * | 4/1993 | Eytcheson | A45D 2/46 | 132/212 |
| 5,365,613 | A * | 11/1994 | Henegan | A42B 1/041 | 2/171 |
| D388,589 | S | 1/1998 | Walker | D2/867 | |
| D412,234 | S | 7/1999 | Cox | D2/867 | |
| 5,920,909 | A | 7/1999 | Ellsworth et al. | 2/171 | |
| 6,427,251 | B1 | 8/2002 | Leach | 2/174 | |
| D513,661 | S * | 1/2006 | Handy | D2/881 | |
| 7,096,510 | B2 * | 8/2006 | Yeadon | A42B 1/041 | 2/202 |
| D572,879 | S * | 7/2008 | Marquardt | A42B 1/043 | D2/867 |
| 7,412,729 | B1 * | 8/2008 | McGovern | A42B 1/041 | 2/174 |
| 7,437,777 | B2 * | 10/2008 | Marquardt | A42B 1/043 | 2/202 |
| D629,180 | S * | 12/2010 | Hood | D2/880 | |
| 7,930,768 | B1 * | 4/2011 | Tyler | A42B 1/041 | 2/173 |
| 8,032,950 | B2 | 10/2011 | Leftenant | 2/202 | |
| D669,662 | S | 10/2012 | Reid | D2/867 | |
| 8,316,466 | B2 | 11/2012 | Saito | 2/204 | |
| D747,855 | S * | 1/2016 | Corcoran | A42B 1/043 | D2/875 |
| 9,907,381 | B2 * | 3/2018 | Tussey | A42B 1/041 | |
| D871,725 | S * | 1/2020 | Smith | A42B 1/04 | D2/878 |
| 2003/0221243 | A1 * | 12/2003 | Phillips | A42B 1/041 | 2/202 |
| 2006/0048277 | A1 | 3/2006 | Yeadon | 2/204 | |
| 2006/0272073 | A1 * | 12/2006 | Marquardt | A42B 1/043 | 2/171 |
| 2007/0214545 | A1 | 9/2007 | Rhodes | 2/207 | |
| 2009/0025119 | A1 * | 1/2009 | Nespor | A41D 7/008 | 2/84 |
| 2009/0089916 | A1 | 4/2009 | Leftenant | 2/204 | |
| 2009/0126078 | A1 | 5/2009 | Rashid | 2/207 | |
| 2010/0043122 | A1 * | 2/2010 | Leftenant | A42B 1/041 | 2/204 |
| 2011/0247126 | A1 * | 10/2011 | White | A42B 1/041 | 2/207 |
| 2012/0079643 | A1 | 4/2012 | Clarke | 2/171 | |
| 2012/0210492 | A1 | 8/2012 | Bielobocky | 2/207 | |
| 2012/0324635 | A1 * | 12/2012 | Shapiro | A61F 9/029 | 2/423 |

OTHER PUBLICATIONS

Internet Publication "Head Covers", hats, turbans and wigs for hair loss, found at http://www.headcovers.com/ht/head_wraps/?gclid=CjwKEAjw8_idBRCExfC15My3owwSJACSDX_WE4WscHH437ZheswEJjU8xJF_pdOaO6rN4VuXWX6XChoC3k_w_wcB.

* cited by examiner

Step 1

Step 2

Step 1

Step 2

Step 3

Step 4

Step 5

Step 6

HEAD HAIR WRAP CAP FOR COVERING OR PROTECTING THE HEAD AND / OR HAIR

RELATED U.S. APPLICATION DATA

This application is a continuation-in-part of application Ser. No. 14/544,462 filed Jun. 3, 2013, entitled "Head Hair Wrap Cap For Covering Or Protecting The Head And/Or Hair", the disclosure of which is hereby incorporated in its entirety by reference thereto.

FIELD OF THE INVENTION

The present disclosure generally relates to head wraps and/or headscarves used when caring for hair; and more particularly to head wraps that envelope hair of the head for use in keeping hair dry, or to protect a hair style.

DESCRIPTION OF THE PRIOR ART

Head wraps, headscarves and hair caps are typically provided for covering most (or all) of the top of a persons, typically a woman's, hair and head. They are worn for a multitude of reasons, including for warmth, fashion, social distinction, for religious purposes, to hide baldness, to manage hair, or as a protective hair covering.

Examples of various head wraps, headscarves and hair caps are set forth summarily below:

U.S. Pat. No. 2,211,184 to Varell discloses a protective hair covering device; and more particularly, a band made of a strip of flexible water-resistant sheet material having a configuration that is adapted to be placed about the head to form a completely closed circular band, enveloping the hair throughout.

U.S. Pat. No. 3,268,913 to Gettinger discloses an adjustable sleep turban.

U.S. Pat. No. 4,468,818 to Flannery discloses a head scarf construction embodying the cooperation of a ply of fabric in a triangulated shape and a stiffened triangulated component connected in positions to bring the base margins of the triangles into alignment, the addition of surface decorations for the triangulated shapes to develop simulations of birds or animals, and tie elements for securing the scarf to the wearer's head.

U.S. Pat. No. 5,007,115 to Denbow et al. discloses a tubular garment which is worn around the neck and optionally at a variety of positions on the head, to provide protection which can easily be adjusted in response to weather conditions. Wearing positions range from covering the neck only, to covering the entire head, including the mouth, cheeks and forehead. The garment's tubular shape is characterized by having the ends of the tube at angles of less than 90 degrees to the sides of the tube. The angled ends provide the adjustability in wearing positions by creating a variation in the length of the tube sides from a maximum at the back of the garment to minimum at the front. The end of the tube which optionally covers the head is further characterized by a drawstring which allows adjustment in the circumference of the end, thus providing a means of securing the garment in the chosen wearing position.

U.S. Pat. No. 5,062,157 to Muta discloses a headband towel head covering held in place by extended strips which fasten together at the back of the head. The towel is pulled back over the head and held in place with fasteners placed on both the towel and the extended strips. It is pulled forward over the head, for removing perspiration and grime from the face and neck area, and conveniently returned over the head during activity. It is also useful to protect from heat or sun while doing heavy physical work, sports activities, lying on the beach, and the like.

Alternatively, the headband closure member comprises an elastic-containing band to effect a firm positioning about one's head.

U.S. Pat. No. 5,144,696 to Kahl discloses an article of clothing comprising an elongated fabric tube and a generally circular elastic band wherein, by passing the band over different parts of the tube, various decorative and functional article forms are provided.

U.S. Pat. No. 5,365,613 to Henegan discloses a hair drying turban made from a single piece of absorbent cloth and having a cap portion and, extending forwardly, a hair basket portion. In use, the wearer places the cap portion on his or her hair with the hair extending forwardly over the forehead and face (the wearer bending at the waist). Then, with the hair placed neatly within the hair basket portion, the hair basket is twisted about the longitudinal axis of the hair. The hair basket portion is then folded backwardly along the center line of the cap portion and secured to the back of the cap portion. A loop is provided for allowing the turban to be easily hung on a door peg and/or, alternatively, to facilitate the tucking in of the hair basket portion beneath the cap portion.

U.S. Pat. No. 5,920,909 to Ellsworth et al. discloses a hair wrap having an annular shape with upper and lower annular edges, having elastic therein, defining upper and lower expandable openings which permit the hair wrap to be placed over the head and down around the neck of the wearer. A pliable material, intermediate the upper and lower annular edges of the hair wrap provides a pocket at the rear of the hair wrap for receiving the hair of the wearer. In use, the hair wrap is passed over the head and down around the neck of the wearer with the hair of the wearer extending over the rear portion of the hair wrap. The front of the hair wrap is then raised above the forehead and the hair extending over the rear of the hair wrap is inserted into the rear pocket of the hair wrap to confine the hair.

U.S. Pat. No. 6,427,251 to Leach discloses a towel wrap for the head comprising a pouch made of a towel-type fabric, the pouch consisting of a generally rectangular piece of fabric having a horizontal bottom edge approximately four feet in length, a top edge spaced above the bottom edge and including a pair of curved flaps, a pair of spaced vertical side edges connecting from the top edge to the bottom edge to form the generally rectangular piece, the flaps having peaks which are about two feet from the bottom edge and the top edge having a center portion which is about 15 inches from the bottom edge, the bottom edge having a portion about two inches wide which is folded over and stitched back on to the fabric so as to provide a two inch wide belt which extends horizontally between the two side edges.

U.S. Pat. No. 7,096,510 to Yeadon discloses a head covering commonly known as a skull cap in which the 'tail' extending from the back of the neck is fashioned into a pouch with an elasticized opening.

U.S. Pat. No. 7,412,729 to Mcgovern discloses a head covering with pocket that can be easily removed and installed with the use of tie strips. A piece of elastic insures that the device will fit on all shaped heads.

U.S. Pat. No. 8,032,950 to Leftenant discloses a head covering is described that is positioned on a head of a wearer to retain the wearer's hair in a desired position. The head covering comprises a hooded cap and an extension. The hooded cap includes a pair of ties and a set of straps.

U.S. Design Pat. No. D388589 to Walker discloses a head wrap of soft fabric.

U.S. Design Pat. No. D412234 to Cox discloses a turban.

U.S. Design Pat. No. D669662 to Reid discloses a headwrap with pouch for hair.

U.S. Patent Application No. 2009/0089916 to Leftenant discloses a head covering consisting of: a hooded portion that sits on top of the wearer's head, a back portion containing a pocket/passageway for the hair/braids to pass through, middle and bottom straps positioned on the back portion of the invention to hold the hair/braids in place.

U.S. Patent Application No. US 2009/0025119 to Nespor discloses a garment for drying the hair and body simultaneously, and a method to use that garment. The garment may include an article of clothing to dry the body, such as a bathrobe or the like, attached to an elongated hood. The elongated hood may envelop and secure the hair to facilitate the drying process. Furthermore, the elongated hood may be detached from the garment. The garment and elongated hood may be made of a water-absorbent material, such as terry cloth, to aid in the absorption of moisture from the body and hair. The garment is useful after bathing or swimming to dry the hair and body while securing the hair out of the wearer's way.

U.S. Patent Application No. US2012/0079643 to Clarke discloses a hair cover for protecting a wearer's v-shaped hairdo while sleeping, having two fabric chambers, one dome-shaped and the other v-shaped.

U.S. Patent Application No. US2012/0210492 discloses a scarf comprising one or more pieces of fabric comprising one or more moldable wires that are located along at least two sides of the scarf, enabling the scarf to be sculpted into a desired shape around the neck and shoulders of a user.

Foreign Patent Application No. GB2296180 to Parry discloses an enveloping wrap for a head of long hair formed as a pouch by two elongate toweling sheet-sections of tapering crescent shape stitched together along an outwardly-curving seam. An open-mouth cap portion receives the crown of the head, and a fillet stitched between inwardly-curved elasticized edges of the sheet-sections defines a pocket for receiving and enveloping the hair within a lower tail portion of the pouch. The tail portion is wound upon itself to twist the enveloped hair tightly within the wrap, and then folded over the cap portion for retention there using an elastic loop. The mouth of the pocket may be closed up onto the hair using a draw string and closed from use using a press-stud fastening.

Internet Publication "Turbie Twist", super absorbent hair towel, found at http://turbietwist.com/ discloses superabsorbent hair towel for drying wet hair generally formed having a pouch and a loop to secure the towel on the head.

Internet Publication "Head Covers", hats, turbans and wigs for hair loss, found at http://www.headcovers.com/ht/head_wraps/?gclid=CjwKEAjw8_idBRCExfC15My3owwSJACSDX_WE4WscHH437ZheswEJjU8xJF_pdOaO6rN4VuXWX6XChoC3k_w_wcB discloses head scarves and wraps.

Despite the aforementioned head wraps, headscarves and hair caps problems in hair care still exist. For example, head wraps/headscarves and/or caps are not adequately secured and as a result, the wraps or scarves fall from the head exposing the hair. Other head wraps/headscarves and/or caps are placed upon the hair in such a manner so that the hair becomes matted and disheveled, completely destroying the hair style.

Accordingly, there exists a need for a head wrap hair cap combination particularly suitable for caring for hair that is securely placed on the head without loosening and falling off. Further, there is a need in the art for a head wrap hair cap combination that completely encapsulates the hair to protect the hair from the elements, as well as to protect the hair style from tangling and matting.

SUMMARY OF THE INVENTION

The present invention provides a head wrap hair cap combination that is readily transformed into a wrap structure that envelopes and fully contains hair resident on the wearer's head. Generally stated, the subject head wrap hair cap combination is formed with a cap portion having two ties and terminating to an elongated pouch. While the cap portion protects the hair on the crown of the head, the elongated pouch receives and houses hair extending from the head. There are generally four (4) hair lengths—short, medium, long and extra long lengths—all of which are readily accommodated by the subject head wrap hair cap combination, which is constructed in four (4) different sizes or lengths to correspond to short, medium, long and extra long hair lengths or for the desired style.

A head wrap hair cap combination according to the invention is appointed for use in the shower and/or rain to keep hair dry, or to protect hair styles while sleeping, exercising, running errands or during indoor and/or outdoor chores, work or activities. A terry cloth interior or diaper cloth is provided to give the option of wearing the wrap after a shower or bath when the hair is wet. At least a portion of the interior may include the terry cloth or diaper cloth material. Alternatively, substantially the entire interior may include the terry cloth or diaper cloth material. Alternatively, a silk interior is provided rather than terry cloth for dry, damp or otherwise non-wet hair, to keep the hair from frizzing up while being worn for a variety of activities, including sleeping, exercising or for fashion when being worn out and about. Improvements to current shower caps are yielded through the use of the hair wrap/cap. While other wrap type devices are generally made to mimic a towel when hair is wet, the subject hair wrap is adapted to provide an improved shower cap designed for hair. The subject hair wrap/cap is adapted to be twisted up or left undone hanging on the back (so hair style is not ruined). Preferably, the exterior is water proof/resistant material is designed to keep the hair dry while maintaining a well kempt style. It also can be used to protect hairstyle in the shower or rain, while sleeping or working-out/exercising, and forms a fashionable head wrap when running errands around town.

Generally stated, the subject head hair wrap/cap and method of use is adapted to protect hair from water or from the environment, providing a shower, rain, indoor/outdoor sports, workout or for a fashion+sleep cap using other alternative materials. In a first embodiment the hair wrap comprises a main body having an interior and an exterior and having a top section forming a cap portion with a perimeter rim, a bottom section forming a pouch, and side walls. The cap portion has at least one attachment, fasten, means located on the exterior of the main body, wherein the cap portion is appointed to fit a head. At least two elongated ties are provided, located on opposite sides of the side walls. The ties are adapted to fall to sides of a users ears and adapted to be pulled down and around then up over the user's head, and to be twisted in front of the top section for securing the wrap on the user's head and mitigating water entry. Alternatively, the elongated ties are located on the pouch mouth opening, preferably located at a central location on the pouch mouth opening and are then pulled up and secured at the front of the head. An attachment means, preferably comprising an elastic loop, is located on a bottom edge of the pouch. The attachment means is adapted to mate with the attachment means of the cap portion. A crown loop located on the top section is adapted to hold the pouch after the pouch is twisted and lifted toward the top section. Whereby the pouch is adapted to lay untwisted when the wrap is in an extended position and whereby the pouch is adapted to be twisted and lifted toward the top section to rest upon the cap portion and secured with the attachment means, preferably being a button or other decorative attachments, when the wrap is in a wrapped position.

According to one embodiment of the head hair wrap/cap, the interior is substantially lined with an absorbent material. Preferably, being a terry material/diaper cloth; or other absorbing material as in micro fibers and/or constructed with a hot/cold material so the wrap cap can be heated or chilled for regulating body temperature. Other materials contemplated for use in the interior and/or exterior include natural fibers such as cotton, chiffon, voile, velvet, crepe, organdy, wool, taffeta, rayon, metallic lurex fibres, Aso oke, Ankara, Afician print, jersey, moray, woven, linen, silk, satin, blue jean, organic fabric, organza, bamboo, muslin, batiste, percale, georgette, brocade, charmeuse, hessian, muslin, gauze, crinoline, denim, damask, tartan, poplin, gingham, velour, polar fleece, second skin, thermoplastic, polyurethane, polyvinylchloride, dintex softshell, dintex bonded interlock, poyyester, tweed, corduroy, khaki, plush, chino cloth, gabardine, broadcloth, textiles, nylon, face fabric, Teflon, polytrtrafluoroethylene, lace, leather, pleather, knit, fur and faux fur. The interior and/or exterior may be comprised of manmade fibers, such as spandex, polyester, satin, fleece, flannel, micro fibers, nylon, acrylic, acetate, rayon and utility, laminate, babyville, protective rubberized, breathable fabric. In a preferred embodiment, the interior is constructed of silk material as its properties keep hair from frizzing and/or to provide fashion or style to the head hair wrap/cap. In another preferred embodiment, the interior is constructed of cotton material to minimize static electricity when hair is dry hair and/or to provide fashion or style to the head hair wrap cap. There may be no interior layer for a more deposable wrap/cap combination. Preferably the exterior is composed of vinyl, plastic, water resistant/water impermeable material in fashionable materials to ensure that the hair does not get wet or damp owing to external climatic elements. The interior and exterior may consist of a silk for just sleeping or fashion. An additional the basic of the wrap/cap structure and ties can be executed in all rubber as an all water protective head wrap hair cap combo (swim cap) for swimming and water protective polyester, nylon, acrylic, acetate and rayon material interior to be less harsh on the hair and easier to place on the head or no interior while maintaining the hair style. It is noted that the term "exterior" and "interior" herein refer to the outside surface facing the outside environment, and inside surface facing the user's hair/head, respectively. The subject hair wrap may be composed of a single layer of material, or may be formed of more than one layer of material. Preferably, each of the ties includes foam or with o wire located in a bottom of the ties is adapted to hold, secure when twisted. However, a softer water protective or form material can be used inside the ties in place of the foam and/or no wirer for a softer hold especially good for sleeping and fashion or as a deposable item. The ties can be omitted and the cap or top section will still remain secure around the head. The pouch's attachment means is adapted to mate with attachment means of the top section (preferably, being an elastic loop adapted to receive the preferable button or a decorative customized stay or fasten respectively). The elastic loop can be changed to a magnet appointed to be received by opposite polarity magnetization instead of a button or exchanged for Velcro with the opposite mate for closure. Other fasteners can be used, such as hook and eye, loop, and snaps as a way to secure twist when received on the top section of wrap/cap. This alternative means of attachment using magnets, Velcro, hook and eyes, loops, snaps may also be used when securing ties, especially good with shorter ties when sewn at the pouch mouth opening in the middle at the base or along elastic edge from side to side, in the end of the ties instead of the u-shape wirer but in the tie ends over lapping each other with the opposite polarity or mate on the opposite tie which is fashioned after ball cap way of closure.

In another embodiment, a hair wrap for enveloping hair is provided comprising: a) a main body having an interior and an exterior and having a top section forming a cap portion with a perimeter rim extending along said cap portion, said top section extending into elongated side walls forming a bottom section extending from said top section, an interior wall attached at edges of said perimeter rim and said side walls forming an elongated pouch and a pouch mouth opening located along said interior wall, said pouch mouth opening extending between and abutting said side walls and said perimeter rim of said top section; b) at least two elongated ties located on opposite sides of said side walls, said elongated ties located at said pouch mouth opening, said side walls and said perimeter rim of said top section, said ties being adapted to fall to sides of a user's ears and adapted to be pulled down and around then up over a user's head, said ties being adapted to be twisted in front of said top section for securing said hair wrap on said user's head and mitigating water entry; c) a pouch attachment located on a bottom edge of said pouch, said pouch attachment adapted to mate with said cap portion attachment; and d) a crown loop located on said top section adapted to hold said pouch after said pouch is twisted and lifted toward said top section. The pouch is adapted to lay untwisted when said hair wrap is in an extended position and to be twisted and lifted toward said top section to rest upon said cap portion and be secured with said cap portion attachment when said hair wrap is in a wrapped position. The wearer can use elastic band, head band, crown band as well as other decorative ornaments attachment means are also provided for use in conjunction with the hair wrap.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE DISCLOSURE

Figure 1:
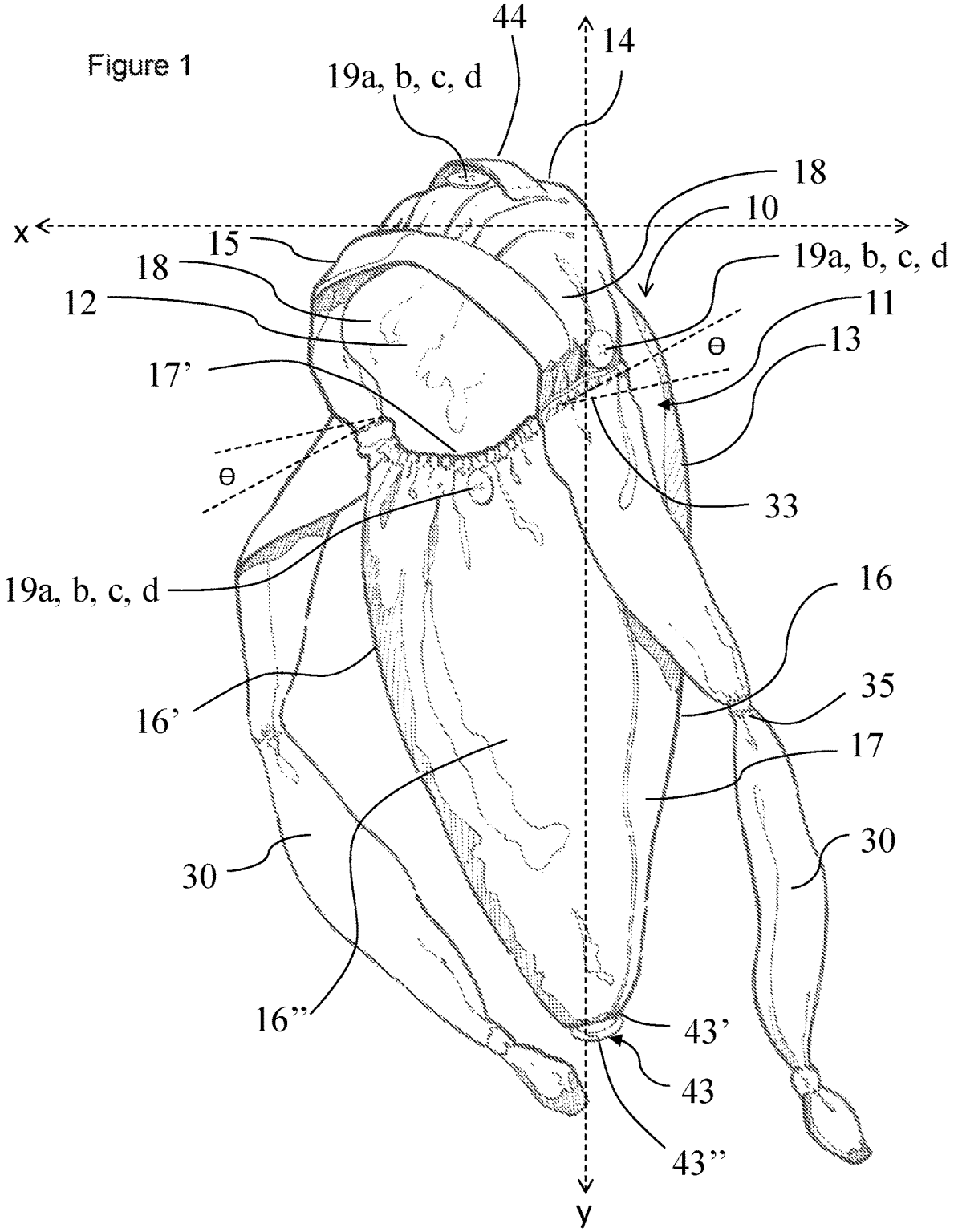
FIG. 1 is a top front plan view of an embodiment of the hair wrap hair cap combination.

The best mode for carrying out the present disclosure is presented in terms of the embodiments herein. The embodiments described herein comprise detail used for illustrative purposes and are subject to many variations. It is understood that various omissions and substitutions of equivalents are contemplated as circumstances may suggest or render expedient, but are intended to cover the application or implementation without departing from the spirit or scope of the present disclosure. Further, it is to be understood that the phraseology and terminology employed herein are for the purpose of the description and should not be regarded as limiting. The headings utilized within the description are for convenience only and have no legal or limiting effect. The terms exterior and interior surface are used herein as structural terms generally indicating the outside surface viewable by the environment and the inside surface facing the head when the wrap is worn, respectively. The head wrap may be composed of a single material (i.e. having an interior surface facing the head and an exterior surface facing the environment) or more than one layer of material.

The subject invention is directed to a head wrap hair cap combination appointed to transform from a wrap structure to envelope and fully contain the hair of the head. Accordingly, the subject head wrap hair cap combination is formed with a cap portion having two ties and terminating to an elongated pouch. While the cap portion protects the hair on the crown of the head, the elongated pouch receives and houses hair extending from the head. Short, medium, long and extra long hair lengths are readily accommodated by the subject head wrap hair cap combination, which is constructed in different sizes or lengths to correspond to short, medium, long and extra long hair lengths. The method to use and construct the head hair wrap cap combination preferably follows six (6) basic steps: 1) place the wrap body over head; 2) place hair in pouch; 3) pull both ties to tighten the wrap and then pull both ties up (when in forward position) and down (when in a backwards position) around head; 4) crisscross ties, loop under and tuck under opposite straps; 5) twist pouch up over head, to the either sides of head, back of head, top of head or base of head; 6) pull twisted pouch through crown loop or depending on the style of twist and fasten the twist on button which will be determined by the style of twist on what button to be used. These six (6) basic steps can be used to apply the head hair wrap cap combination to short, medium, long and extra long hair lengths regardless of wearing wrap/cap in a forward or backwards position. All wrap/caps preferably have one to four button positions. The choice of button to fasten the end loop on depends on the desired style and is determined by the length of the pouch.

Accordingly, the extra long wrap length is configured to rest below the bra strap and extends to the waistline of an average height female. Generally, the length of the extra long wrap ranges from about 21 inches to 30 inches beneath the base of the wrap or beneath the cap portion. Pouch length is determined or measured from the pouch mouth opening/base of the wrap to the bottom edge of the pouch. To apply the wrap onto the head, the user basically applies six steps. First, the user directs her head down towards the knees and applies wrap backwards with the ties at the front of head and the perimeter rim at the base of neck. The ties are then pulled down and around the base of neck, looped under each other, tightened and tucked on opposite sides of head by the ears. The pouch is then twisted into a cinnamon bun shape at the front of head and the twist is fastened with the end elastic loop on the button located at the side of either the right or left side of head by the ears or on the button located under the crown or base material loop. The x-long wrap can also be worn in the same forward fashion as the long wrap, short wrap or medium wrap. Then the pouch is then twisted into a cinnamon bun over the right or left shoulder and fastened on a button at the side of the head by the ear on either the right or left side or twisted centered at the base and fastened at the buttons under the crown material loop or the base material loop. The long wrap when applied forward with the perimeter rim on front of head; the same steps are followed, as mentioned herein above in connection with the extra long wrap. For the long wrap, the pouch length should be slightly below the bra strap; typically ranges from about 18 inches to 21 inches there below. After applying forward in the basic six (6) steps set forth herein, the pouch is then twisted, pulled up over back of head, pulled through the crown loop and fastened by the elastic end loop on the side button above the ear either to the right or left side of head or twisted in a rosebud over either the right or left shoulder and fastened on the button on the right or left side of head by the ear or in a rosebud at the center base and fastened on the button located under the base material loop. The long wrap can be worn backwards following the six (6) basic steps described above as in the extra long wrap/cap with the pouch at the front of the head twisted in a rosebud shape, pulled through the crown material loop and fastened on the button to the right or left side of the head now located below the ear. The pouch can be twisted clock or counter clock ways which may then determine if the button to the right or left side is used for fastening. This may coincide if depending on whether the person applying the head hair wrap is right handed or left handed, which is why the button is offered on either the right or left sides of head. The subject wrap/cap is appointed to be offered for a right handed or left handed application.

Preferably the short wrap length is to the shoulders of a user. Generally the short wrap has a length ranging from between 1 inch to 12 inches from the base up to 15 inches. Application of the short wrap onto the head follows the 2 basic steps. To apply forward the user places the wrap/cap on head, then places the hair in the pouch, pulls the ties up and around the head, loop the ties under each other, tightened and tucking each end under one another on the opposite sides. Then, the pouch is twisted up over the head and fastened by way of the button located under the material crown loop or to the sides or either the right or left side of head on the button located above the ear. The short wrap/cap can again be worn backwards directing the head downwards toward the knees and applies the wrap with the ties at the front of the head and the perimeter rim at the base of the neck. The ties are then pulled down and around the base of the neck, looped under each other, tightened and tucked on opposite sides of the head by the ears. Then the pouch is twisted and fastened by the elastic end loop on a button located at the right or left side now below the ear and can also be twisted simply and fasten back on the button located under the crown material loop.

For the medium wrap, the length should be below the shoulders, and generally range between about 15 inches to 18 inches. To apply forward the user should follow each of the (6) basic steps. Thereafter, the pouch is twisted at the base in the shape of a donut and fastened on the button located under the base material loop or over the right or left shoulder and fasten on the button by the ear on the right or left side of the head. The pouch twisted pulled up over the head through the crown material loop and on the button on the center front of perimeter rim. The twist can be rotated to either the right or left side of head and fastened on the center button as well. The medium wrap can also be worn backward following the six (6) basic steps in which the donut shape twist is now on the top of the head fastened on the button located under the base material loop or back down the back of the head through the crown material loop and on the center button that is now located at the back of head. In addition to the four (4) wrap lengths there is optionally a mini wrap and an x-extra long wrap if needed. A mini wrap/cap would be for infant and/or young children wear. The size of the hair wrap can readily be adjusted to provide the different sizes to accommodate the stated sizes.

The head hair wrap cap can be used as a decorative fashionable head wrap cap in cases the wearer has no hair. The wrap protects the hair or the head, as the case may be, if the wearer has very thin or no hair. The wrap does not need hair inside it to be functional. Irrespective of the amount of hair present, the wrap will hold tight on the head, and the pouch will still have shape to it when twisted with or without hair inside. The hair does not have to be well styled to be kept dry. This being said, the hair also can be wet when inside the cap because of the terry cloth lining or other materials that are moisture absorbent. Optional interior material is contemplated; such optional hot/cold material will additionally aid in keeping the hair dry and kept by regulating the body's temperature to create there within a micro climate best suited to achieve this objective despite variance in climatic wearing conditions and activities. Other additional interior material may also include silk or satin so that the hair will not frizz up and the wrap/cap with both the interior+exterior for sleeping and fashion. The wraps may also then exclude the wirer+foam inside the ties or exchanged for a water protective or form material in the ties+perimeter rim for a more comfortable sleep and good for a deposable wrap/cap combination. The wrap/cap can be twisted and worn in many versatile ways however; the wearer may discover different ways to twist the pouch for a different style so they may also choose to change the button placement. This will not hinder the protective nature of the head wrap hair cap combination because the elastic and ties remain both secure around the head and solely effect the pouch being twisted to a desired style.

A head wrap hair cap combination according to the invention is appointed is made in form of a rain cap and shower for use in the shower and/or rain to keep hair dry, or to protect hair styles while sleeping, working or running errands. A terry cloth interior is provided to give the option of wearing the wrap after a shower or bath when the hair is wet and may be offered in a full terry material exterior and/or no interior for salon use. Improvements to current shower caps are yielded through use of the hair wrap. While other wrap type devices are generally made to mimic a towel when hair is wet, the subject hair wrap is adapted to provide an improved shower cap designed for hair. The subject hair wrap is adapted to be twisted up or left undone hanging on the back (so hair style is not ruined.) It also can be used to protect hairstyle while sleeping, working out or as even as a fashionable head wrap when running errands around town. It may be done in a vinyl/plastic exterior with or without an interior, ties done with or without wire and foam for a deposable wrap cap combination. It is contemplated that the subject disposable hair wrap has idea applications for use with hotels, amusement parks, or outdoor venues, or to provide an easy to carry hair wrap for inside a purse for emergency use. A softer water resistant/form material may or may not be used in ties+perimeter rim instead for shape. This deposable wrap cap could come with hair treatments inside for an easy at home or travel use. Hair treatments may include, for non-limiting purposes, keratin treatments, conditioners, and/or hair nourishments.

Figure 2A:
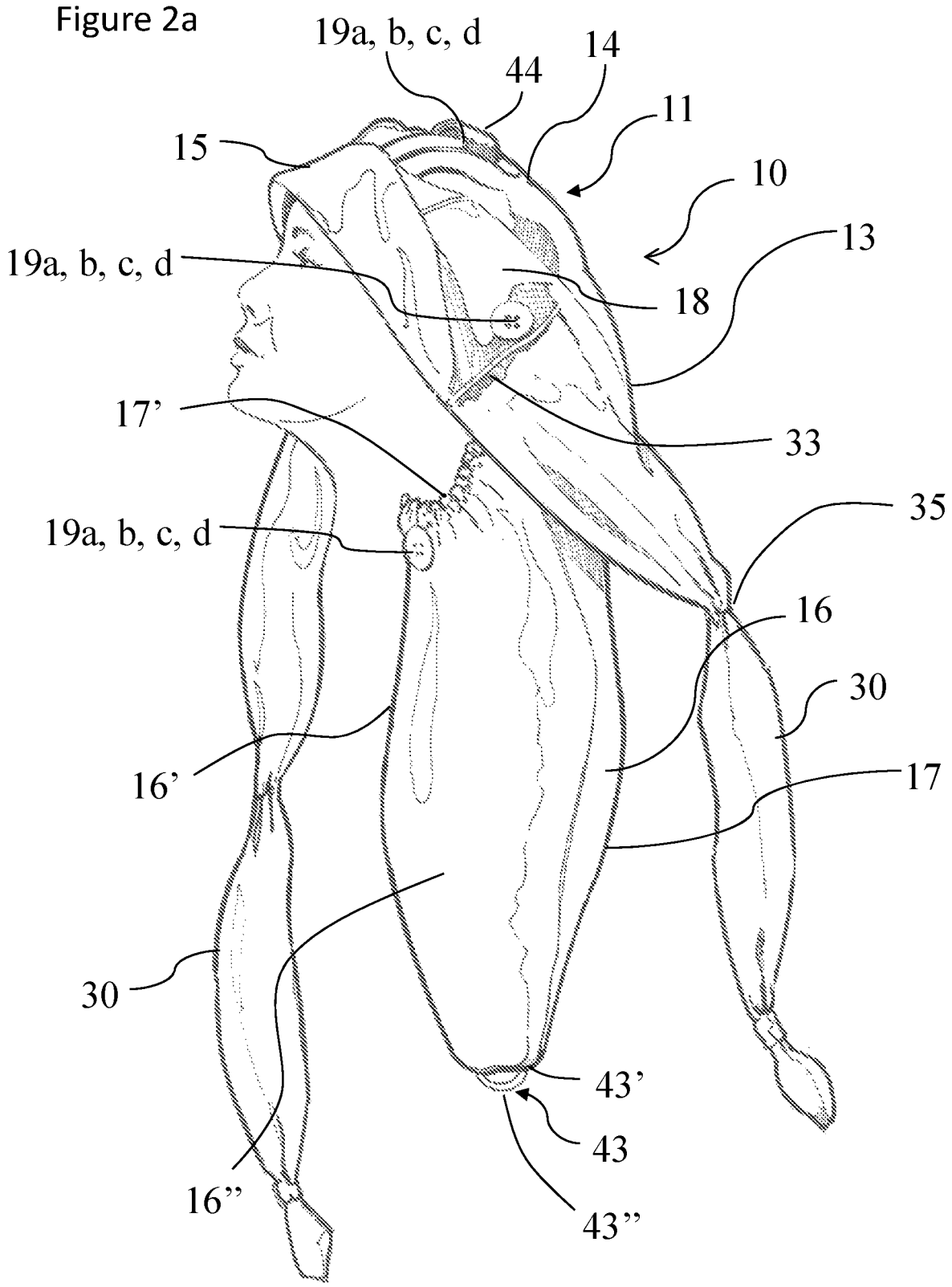
FIG. 2*a* is a side view of the hair wrap of FIG. 1.
Figure 3:
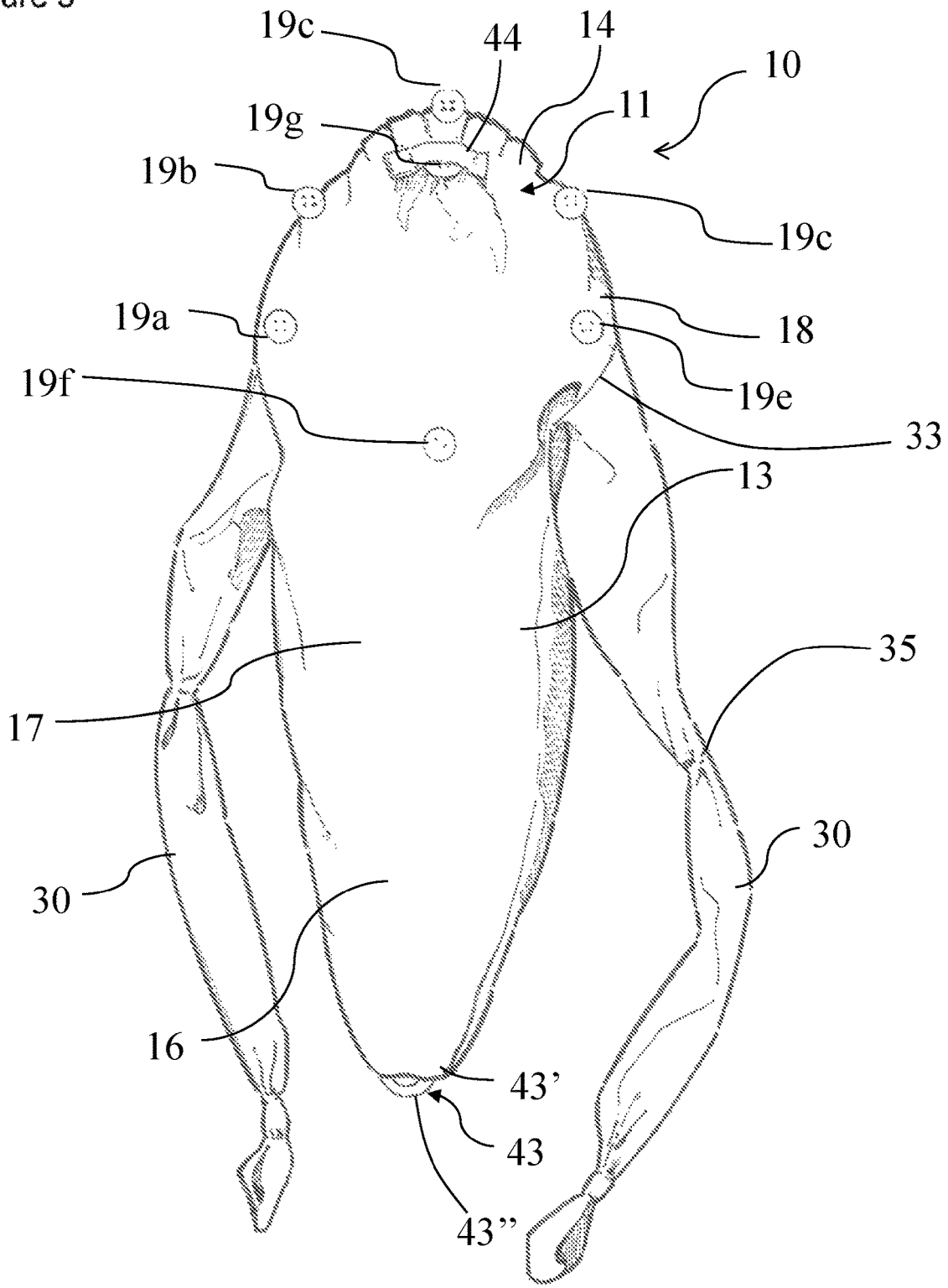
FIG. 3 is a rear view of the hair wrap of FIG. 1, showing button placement options.
Figure 4:
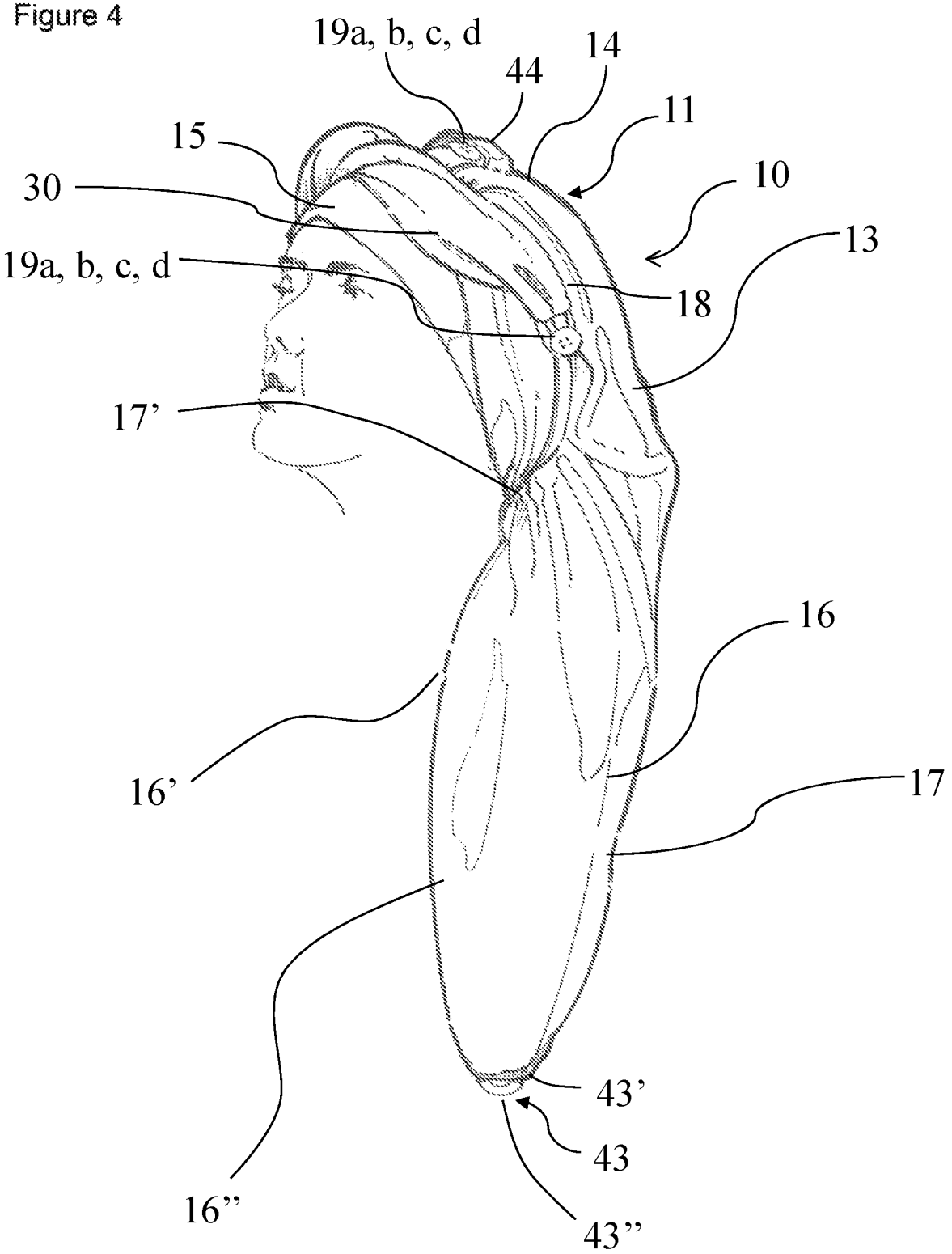
FIG. 4 is a frontal view of the hair wrap of FIG. 1, wherein the wrap is placed on a user's head and the pouch is in the extended position.
Figure 5:
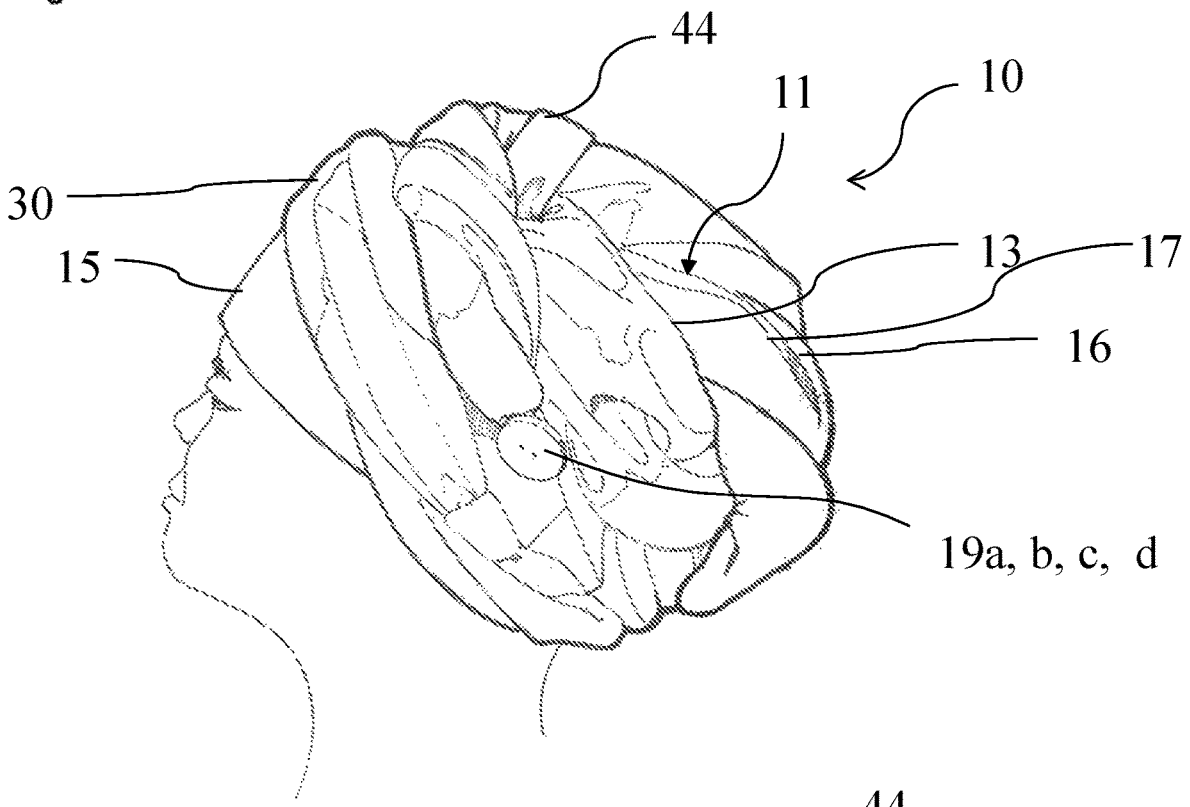
FIG. 5 is a side view of the hair wrap of FIG. 1, wherein the wrap is placed on a user's head and the pouch is in the twisted and wrapped position.
Figure 6:
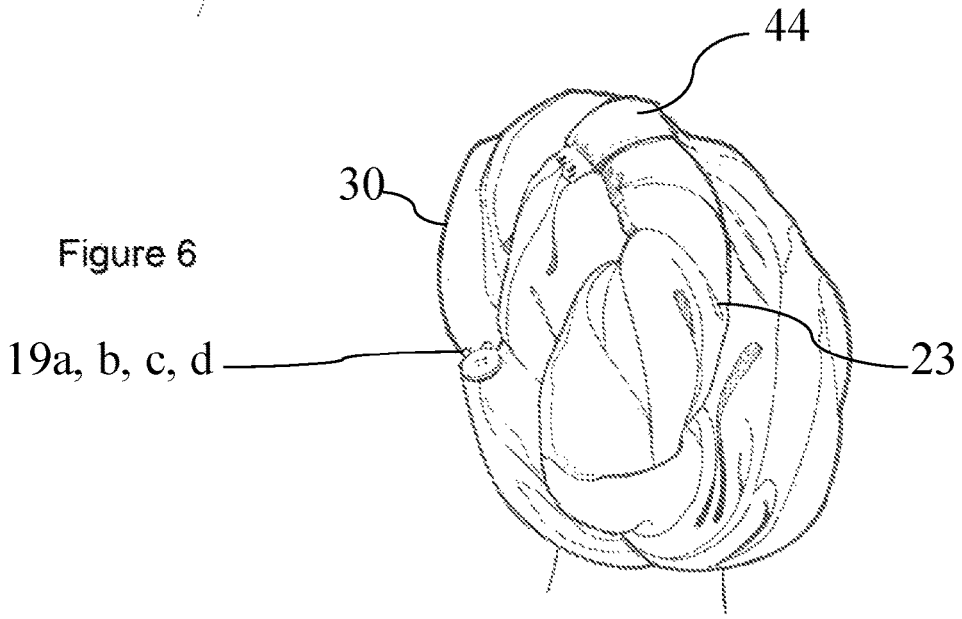
FIG. 6 is a rear view of the configuration of FIG. 5, showing twist threaded under the crown material loop and fastened on side button.
Figure 7:
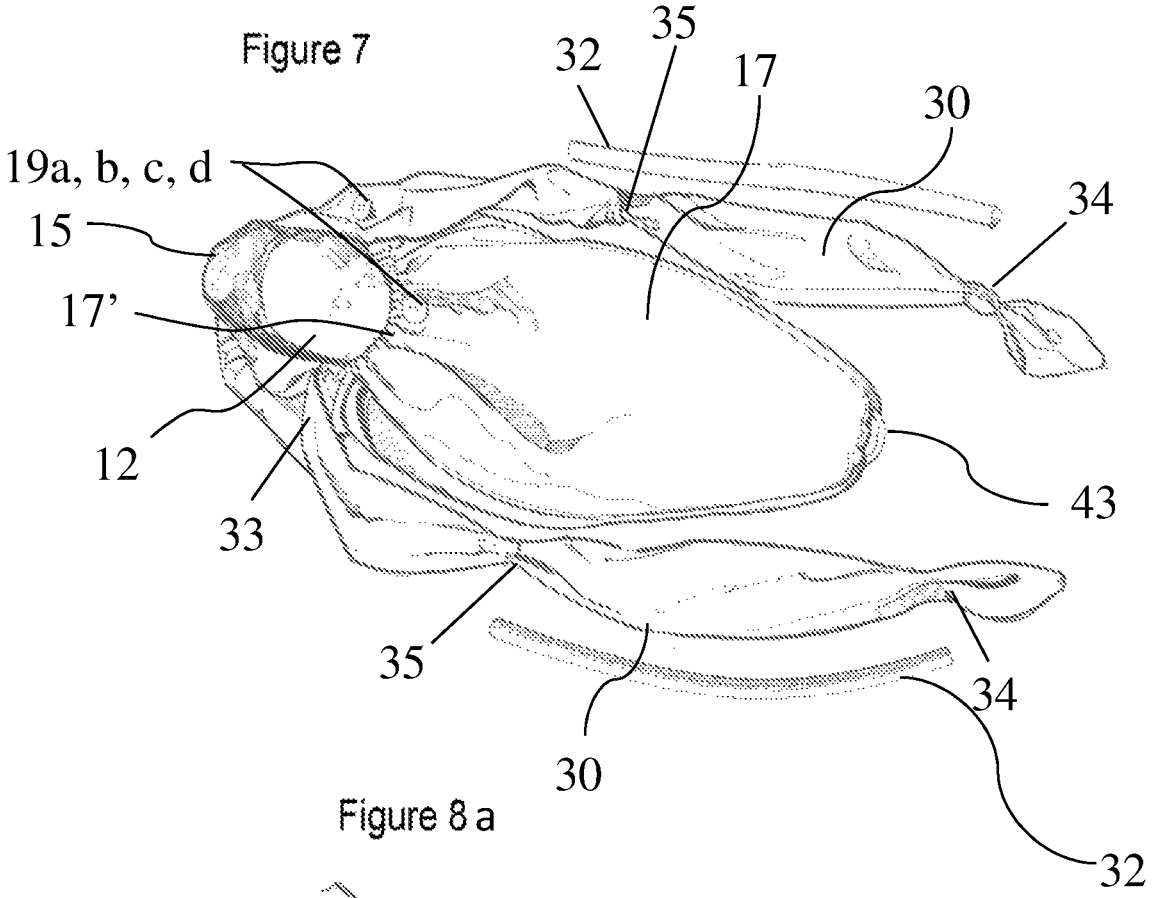
FIG. 7 is a top plan view of the hair wrap of FIG. 1, wherein the wrap is removed from the head and placed for later use, showing foam next to each tie where it would be placed inside the tie from $1^{st}$ knuckle to the $2^{nd}$ knuckle.

FIGS. 1-8, 12*a*-15, 17-25 illustrate an embodiment of the hair wrap and methods of using same. FIG. 1 illustrates a top plan view of an embodiment of the hair wrap hair cap combination, shown generally at 10. FIG. 2*a* illustrates a side view of the hair wrap of FIG. 1. FIG. 3 illustrates a rear view of the hair wrap of FIG. 1. FIG. 4 illustrates a frontal view of the hair wrap of FIG. 1, wherein the wrap is placed on a user's head and the pouch is in the extended position. FIG. 5 illustrates a side view of the hair wrap of FIG. 1, wherein the wrap is placed on a user's head and the pouch is in the twisted and wrapped position. FIG. 6 illustrates a rear view of the configuration of FIG. 5. FIG. 7 illustrates a top plan view of the hair wrap of FIG. 1, wherein the wrap is folded, removed from the head and placed for later use.

Figure 8A:
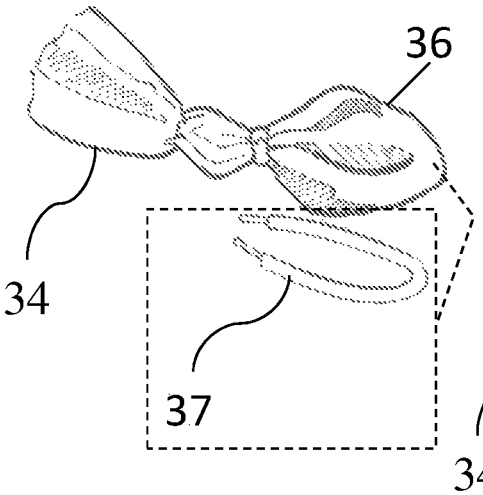
FIG. 8*a* is a top plan view of the hair wrap of FIG. 1, showing the foam with wire located in the ties.
Figure 8B:
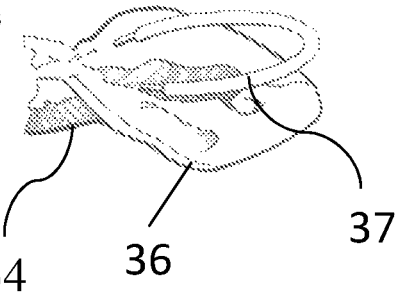
FIG. 8*b* is a top plan view of the foam with wire outside of the ties.

FIG. 8*a* illustrates a top plan view of the hair wrap of FIG. 1, showing the foam with wire located in the ties. FIG. 8*b* illustrates a top plan view of the foam with wire outside of the ties. FIGS. 12*a*-15 and 17-25 illustrate the hair wrap and various non-limiting methods of use.

As shown generally in FIGS. 1-8, the hair wrap 10 for enveloping hair comprises a main body 11 having an interior surface 12 and an exterior surface 13. Preferably, the wrap is made up of two sheets forming the interior 12 and exterior 13 layers of the wrap 10, respectively. A third interior layer may be provided between the two sheets for extra absorption properties or for providing extra thermal properties. Alternatively, the wrap can be made up of a single sheet of material, having an interior and exterior (outside facing). The exterior is preferably designed with material that is water protective. This supports the head hair wrap cap main function to keep the hair dry and kempt. The wrap is very versatile and can be worn in many ways such as (when showering, when it's raining, when sunning by the pool but not under water). Because of the attractive water protective material, the head hair wrap cap can be worn when running errands, working out and during outdoor activities and sports (such as rock climbing, riding a bike, skiing, boarding, motorcycling, riding in a covetable and the like. The cap can also be worn as a sleep cap. Twisting of the pouch while hair is inside protects and maintains the integrity of the hair. Damage to the condition of the hair is prevented. The cap properly protects the hair while maintaining the hair style of the wearer.

The interior 12 may be substantially or virtually entirely lined with an absorbent material for drying wet hair within the wrap 10. Terry cloth, diaper cloth, cotton, micro fiber and other highly absorbent materials may be used. The interior can be constructed with different materials. Terry cloth material is well suited to absorb excess water or moisture. The terry cloth/diaper cloth construction is such that when the hair is damp it can absorb moisture and thereby keep the hair from drying up too quickly when uncovered. This allows a person more time before styling the hair with a blow dryer. The terry cloth material also acts as an absorbent when wearing the wrap during work outs or during outdoor sports activities or in cotton for a more breathable material. Since the material is washable it is suitable for use when a hair treatment has been applied to the hair. The interior may comprise of a hot/cold material that can be heated in a hot cabby or cooled in the refrigerator. As mentioned above the hot/cold cloth material can be used when sitting under a dryer with a hair treatment on the hair. Whether hot or cold the hot/cold cloth will help to regulate the body's temperature. Such cloth material is well suited to be chilled for use when working out, during outdoors activities, when lying in the sun or to provide comfort during menopause or for migraine headaches. When heated it may also help with migraines or other health issues such as the application of topical ointments to promote hair growth. When heated, the wrap is well suited for cold weather use in cases the head is bald or has thin hair. The presence of water protective material makes it well suited for use in snow. It is preferable that a top section 14 of the cap and a bottom section 16 of an elongated pouch 17 include the absorbent material to dry the user's full length of hair.

Main body 11 has a top section 14 formed as a cap portion with a perimeter rim 15 that is an arch or curve with the apex of the curve arranged substantially on a horizontal plane (x). The cap portion or top section 14 extends downward on a substantially vertical plane (y) forming a bottom section 16 having an elongated rim 16'. An elongated sheet of material or interior wall shown at 16" is attached to or otherwise sewn along the entire elongated rim 16' of bottom section 16 thereby forming an elongated pocket or pouch 17 enclosure having a top interior wall rim forming a pouch mouth opening 17' attached to opposite ends of perimeter rim 15. The perimeter rim 15 edges terminate at and abut the edges of the pouch mouth opening 17', so that as attached the two elements essentially form a continuous circle or oval from the bottom view (see FIG. 16) with elongated ties 30 abutting and between opposing perimeter rim 15 edges and pouch mouth opening 17'. The elongated ties 30 thereby hang over the pouch mouth opening 17' edges or pouch mouth opening 17'—perimeter rim 15 edge interface (for a clear image of the arrangement, see FIG. 16). The elongated ties 30 are attached to the perimeter rim 15 and pouch mouth opening 17' interface at an angle θ, ranging from about 90° to 45°. In this construction, there are no gaps or openings between the perimeter rim 15, side walls 18, pouch mouth opening 17' and elongated ties 30 so that the user's hair is completely covered, even at the nape of the neck and behind the ears. Preferably, the elongated ties have a length ranging from 1 inches to 36 inches. More preferably, however, the elongated ties from the top section side walls have a length 12 to 26 inches which allow the ties to be adapted to generally wrap 1 time around the wearers head. In addition, the ties could be shorter from 4 to 10 inches to fasten at the base of the neck a ¼ time around the head. This may fluctuate depending on the wear's size of head. Preferably, the elongated ties are 9.5 inches to the first knuckle/seam+ 22.5 inches to the $2^{nd}$ knuckle/seam if the foam was placed inside the ties 26 inches to the end. However, the ties can be shortened to a medium length 12 inches to 18 inches which would then be adapted to be wrapped just ¾ around wear's head. The shorter ties could be worn when the ties begin off the top section by the ears and fasten right at the base of the neck or when both ties have been repositioned at the middle of the pouch mouth opening where the base material loop was formally positioned. When the ties are sewn along the elastic mouth opening entire length from side to side along seam or in the middle of elastic base with a seam. This allows the ties to fall around the base of the neck when in a forward position giving an extra lining around the hairline or when in a backwards position along the forehead. It is noted that the elastic could be removed from the pouch mouth opening when ties are sewn along the width. The ties in a forward position placements are, short length ties from the side walls ending at the base of neck 4-10 inches, medium length ties starting from the middle of pouch mouth opening 17 to 24 inches wrap at the opposite point of head at the top or long length ties from the sides walls by the ears 26 to 32 inches in length which wrap down and around back up over head and fasten to the sides. The ties placement would be in reverse if wrap cap were in a backwards position. The ties when short to fastened at the base of the neck a piece of foam could be added within the flat perimeter rim instead of a form material or it would be a good option to wear the head band with 1-2 piece of form to give the wrap cap more shape. In addition, if the top section, bottom section and pouch were constructed with only one seam up the underneath side of the pouch then the perimeter rim and pouch mouth opening would be adjoined and the elastic be a continuum as in a traditional shower cap. This being said the elastic could be completely removed and rely on just the ties to tied for security around the head. The ties could coincide with the length of the pouch or not because the pouch is determined on the length of the hair or how you wish to fashionable wear the head wrap hair cap. The ties are also how you wish to fashion the head wrap hair cap because the ties short, medium or long can be worn on all 4 length of pouch (short, medium, long or extra long). This is again an example of the many multiple ways the head wrap hair cap can be design. There are variety of ways the head wrap hair cap can also be twisted and styled using any type of material or fabric and adding personalization using the 3 bands (head, elastic+crown) as well as adding ornamentation.

The elongated ties 30 may include flexible coated wire ends (see FIGS. 8*a*-8*b*) for securing the ties 30 when the hair wrap is worn, or may be secured with velour, snaps or magnets located on or within the elongated tie 30 ends. Corresponding mating attachment means (shown generally as buttons in the Figures as 19*a, b, c, d* . . . ), velour, snap, button, magnetic surface are then provided at locations as described herein (see 19*a, b, c, d* . . . in FIGS. 1-8). Wherein wire ends are provided within the $2^{nd}$ knuckle (i.e. distal section) to the ends of the elongated ties 30, mating attachment on the hair wrap top section is not necessary. Also an absorbent stripe of material can be used under the ties from where they fall off the perimeter rim to where the first knuckle or indent is placed to seal water migration from entering or for absorbing sweat or a softer material can be used for comfort. Also, the ties may contain inside a softer water protective or form material inside for more shape and comfort as well.

Bottom section 16 is formed having side walls 18 that extend between cap portion and top section 14 and pouch 17 with a circumference 18½ to 35 inches. At least two elongated ties 30 are located and attached to opposite sides of the sidewalls 18 and opposite ends of perimeter rim 15. The pouch mouth opening 17' extends between and abuts the side walls and the perimeter rim 15 of the top section 14. Top section 14 and bottom section 16's pouch 17 are adapted to receive hair extending from the head. Owing to this construction, the cap portion and bottom section, with side walls 18, envelope both the head and the hair of a user because the pouch mouth opening 17' extends and abuts the side walls 18 and perimeter rim 15 thereby providing a large opening without any gaps or openings.

Perimeter rim 15 is formed from the flat strip of material generally 3" wide, and preferably 1¾ wide 16" long, that attaches to the top section 14 extending in an arch or curve so that is essentially sits from ear to ear on the wearer. A small piece of elastic could be added to the seam between the top section 14 and perimeter rim 15 for more security if desired in design. The flat perimeter rim 15 resembles a scarf tied around the head. The ties 30 are tied in front of the seam to disguise pleats at the top section 14—perimeter rim 15 seam or interface, which pleats are added to increase head space within the cap so hair does not get flattened. Absorbent material can be added underneath the perimeter rim from side to side to seal off water from migrating or to absorb sweat. The perimeter rim can contain a softer water protective or form material inside for my shape and comfort. The perimeter rim could also be designed to continue into the ties as a solid piece of material length 1 to 68 inches continuum. In other words, preferably the perimeter rim and elongated ties are formed from a single, unilateral un-interrupted piece of material. For example, wherein the rim has a length (R) of about 16 inches, and each tie has a length (T1, T2) of about 26 inches, the continuum equals R+T1+T2 or 16"+26"+26"=68 inches. This continuum or single piece of material forming the ties and rim as a single unilateral piece of material results in a scarf essentially integrated with the top section when the head wrap is worn on the head.

The main body 11 is preferably constructed of one solid piece of material which is seamless; and consists of the top section 14, which is the cap section that fits the head, and extends down the back of the neck into the bottom section 16 forming the elongated pouch 17 of the wrap. The top section 14 is constructed to fit the head like a shower cap. The perimeter rim 15 is formed as a flat strip of material having a generally arched or curved shape. An absorbent material and/or a soft band of material for comfort may be located under flat strip forming perimeter rim 15. The flat strip of material of the perimeter rim 15 is adapted to sit flush against and hug the forehead/hairline top crown of a wearer. The perimeter rim 15 preferably is made with this same type of material as in the wrap/cap the design looks like a solid piece of material that mimic's a long scarf tied around the head in a boho fashion from the 60's. However, does not include an elastic band or insert, but is formed as the substantially flat strip which itself may be formed of a stretchable or flexible material (nylon, etc.) when the same type of material is being used for the wrap/cap design as to match the fashionable workout wear as in running wear, yoga wear+gym wear. Preferably, the flat strip of material forming perimeter rim 15 has a band depth extending from an outer edge to an interior edge which abuts and terminates at top section. However the perimeter rim could be a continuum strip of material forming the ties without a break or seam at the extending from the top section 14. Preferably, pouch mouth opening 17' includes an elastic rim that extends completely therein so that it hugs the base or back of the head/neck so no moisture/water is allowed underneath and the hair will remain dry and kempt. Perimeter rim 15 and pouch mouth opening 17' abut and are attached to one another.

To apply the head hair wrap cap one stretches the pouch mouth opening 17' elastic band with both hands and then stretches it while placing the head hair wrap cap/top section 14 over the head with the perimeter rim 15 snuggly fitting around the forehead/crown of the user and the user inserting his/her hair into the pouch mouth opening 17' at the nape of the neck. The wrap/cap in (short, medium, long and extra long) can all be worn backwards as well as forwards.

The perimeter rim 15 stops on top of the ears; however when the ties are pulled the perimeter rim 15 may stretch below the ears. The ties are sewn horizontally onto the opposite ends of the perimeter rim 15 and side walls 18 of the main body. Then the perimeter rim 15 snugly hugs the user's head (crown/forehead—hairline area) while the pouch mouth opening 17' slides down and around the back nape of the hair. The band is designed so when the ties are pulled the perimeter rim band appears flush to the face. This then gives the appearance of a scarf tied around the head and is not bumpy like a shower cap. The perimeter rim is preferably 16 inches to 20 inches in length and could be a continuum into the pouch mouth opening of generally 1 to 24.5/30 inches. Also a piece of foam could be added within the perimeter rim and could or not extend into the ties when short, medium or long in length.

The bottom section 16 is an extension from the main body of the head hair wrap cap forming the top part of the pouch. The bottom section's interior wall 16" is an additional piece of material sewn on the underneath side of bottom section along the perimeter rim 16' of the bottom section 16, as discussed hereinabove, which lies along the shoulders and down the back referred to as the pouch 17. The separate material/interior wall 16" allow changing up of the color and/or texture so the head/hair wrap cap begins to take on more of a pattern in color and in the design if desired. The bottom section begins along the entire periphery of the base of the top section and can be as long as the small of the back.

Pouch 17 is adapted to receive hair extending from the head—such as short, medium, long or extra long hair strands. Main body 11 is formed having side walls 18 that extend between cap portion and top section 14 and pouch 17. The side walls comprise the inside interior along the side of the head. They are again constructed of one solid piece of material with the side walls hugging the sides of the head and secured by elastic. The side walls add shape while the head hair wrap cap hugs the head when elastically-secured and closed by the additional security of the ties. Cap portion/top portion 14 preferably includes at least one attachment means or cap portion attachment located on the exterior 13 of the main body 11. In the present embodiment, the attachment means is shown as buttons at locations 19 (*a, b, c*, and/or *d*). The attachment means/button 19 is shown, however it is noted that the location of the button is provided in multiple places depending on which head hair wrap cap it is on. For example, the button is shown represented as 19*a, b, c, d* to represent the button location for the long wrap, the medium wrap, for the short wrap, and for the x-long wrap. A crown loop attachment means, shown as the button at the top location (19*a, b, c, d*) under crown loop 44 is shown for securing the pouch. Attachment means/buttons 19 (*a, b, c, d* . . . ) are shown in FIG. 3 as seven buttons, located at 19*a, b, c, d*, for example 19*a* (below ear), 19*b* (above ear), 19*c* (apex of the perimeter, 19*d* (above ear), 19*e* (below ear), 19*f* (back base) and 19*g* (crown loop attachment button). All pouch lengths can be fastened on all button positions, depending on the style and/or the volume of hair. For example, the extra-long wrap may have 3-5 buttons; the long wrap may have 3-4 buttons; the medium wrap may have 3-4 buttons, and the short wrap may have 2-3 buttons. However, the buttons on all wraps (XL, L, M, S) may have anywhere from 1-10 buttons. The wrap 10 represents all long, medium, short and extra-long wrap configurations, representing (4) lengths of the pouch 17. The button is used to secure the twist by the end elastic loop located at the very end of the pouch. However, each wrap/cap (short, medium, long+extra long) may have at least (1-5) buttons or decorative attachments used to fasten the pouch tight after it has been twisted using the elastic end loop to fasten. This allows the wrap/cap to have at least (1-5) different style per wrap/cap. The short has (1-2) buttons. The medium wrap/cap has (1-4) buttons and both the long+extra long have (1-5) buttons. The buttons or attachments maybe customized or personalized with logos done in metal, stone, rock, wood, plastic and may also include monograms or stitched on, stamped on, molded designs. The button maybe exchanged for a strong magnet for a closure option as well as a hook and eye, Velcro, loop or snap for additional options.

The at least two elongated ties 30 are located on opposite sides of the sidewalls 18. The two ties are located on both sides of the head on top of the ears. The ties material may match exterior or the top and underneath or just the underneath material of the tie in a different material to add more pattern and color if desired in design. This may coordinate with the underneath material of the pouch or again different materials to add more pattern+color if desired in design. Ties 30 may have an absorbent material from proximal end 33 to midpoint 35 (or knuckle). Preferably, the total length of the ties 26.5 with 9.5 inches to the first knuckle+22.5 inches to the second knuckle or distal section and 26.5 inches to the distal end. These knuckles/seams that are needed when there is foam and/or rubber coated wirer in the ends inside the tie's to hold in place. The foam is generally ⅜ diameter, ⅝ diameter however, preferably ½ diameter. The basic need for the foam is to give more shape to the ties however the ties could be twist around itself as would be done in the use of a scarf wrap which is what the head wrap hair cap was design to assimilate in its appearance or another alternative could be done in a braid shape. A foam, water impermeable/form material or no insert can be used with in the ties. The rubber coated wirer is generally 1 to 10 inches, and preferably 6 to 8 inches, folded in half and inserted into the end distal end of ties secured with a seam and is used to be bent around ties for more security. The rubber coated wirer could also be omitted or replaced by another means of security as mentioned. The ties have a circumference generally 1 to 10 inches, and preferably 4 to 7 inches.

The ties may include, though not preferably, holding in place by a material base loop (not shown) located on the pouch mouth opening. This is so when the ties are pulled up and around the top of head in a forward position. The material base loop helps to close the mouth of the pouch up tighter, to secure a shut condition. The ties are pulled down the sides back under the base and up to secure a shut condition during the forward application. The two ties are crisscrossed, tied or twisted ½ way around and tucked under the opposite ties to secure a tight condition. Ties 30 are elongated and are adapted to fall past the sides of a user's ears and are ample in length to be pulled down and around then up over the user's head. The ties 30 are adapted to be twisted in front of the top section 14 for securing the wrap 10 on the user's head and mitigating water entry.

When the ties are pulled to tighten the head/hair wrap cap around head the ties are then crisscrossed and tucked under the opposite side of ties to secure them in place. The width of the ties secure the closure created by the mouth 17' by lapping over one another and the elastic band pouch mouth opening 17' at the base and is not influenced by how tight the ties are both pulled as to be secured and well fitted. When the ties are grabbed by both hands at the base of neck and now pulled the wrap then tightens around the head because of the ties being pulled up and around the top of head, crisscrossed, tied and tucked on opposite sides of the head. The optional material base loop also assists so the mouth of the pouch is pulled up tighter to close the opening of pouch and secure from water. However, the ties can still be pulled tight and are just as affective with securing the head/hair wrap cap tight when used without the ties going through the optional material base loop. The wrap can be worn with or without the use of the material base loop. Also, because the ties determine how tight the top section is to the head the wearer has the option to pull the ties loosely or not pulled so there is more room in the top section so hair volume+style remain full and still affective in preserving the hair from wetness. This may be desired when in the rain or even shower when pouch is left untwisted. The ties can be omitted for a simple shower cap/rain cap done with or without crown material loop and attachment to secure twist. However, this wrap/cap combo is design so all (4) length (short, medium, long+extra long) can be worn backwards as well so that the hair is pulled up on the top of the head so the hair volume at the root is preserved.

Additionally, an attachment means 43 is located on a bottom edge 43' of the pouch 17 for mating/fastening with the attachment means 19 (*a, b, c, d*) of the cap portion/top section 14. A crown loop 44 is located on the top section 14 adapted to hold the pouch 17 after it is twisted and lifted toward the top section 14. The crown loop is designed on all four (4) (short, medium long and the x-long wrap/cap combinations so even if not used as in the short it is used to hide the button underneath. However the crown loop may be omitted on all four (4) wrap/cap combinations and the twist will still be functional. When the pouch is twisted in a forward position it can be pulled up over the back of the head, through the crown loop, twisted to the right or left side over the shoulders, pulled up then back down through the crown material loop or in the shape of a donut, rosebud or cinnamon shape. When wrap/cap is worn forward or backward, the twisted pouch can be fasten with the elastic end loop and depending on the length fastened to either the right or left button below the ear, by the ear, at the crown loop, middle of base or at the front or back center. The pouch can also be twisted in a cinnamon bun as in the extra long wrap forwards and backwards, a rosebud as in the long wrap forwards or backwards, a donut shape as in the medium wrap forwards or backwards and a simple twist for the short wrap in a forwards or backwards position. The wrap/cap can be applied with the pouch forwards or backwards with the pouch to the front top of the head or at the back by the base of the neck. All first (6) steps can be applied in the same backwards or forwards so that the cinnamon bun, rosebud, donut or a simple twist is now on the front forehead position or on the back by the base of the neck or in the other twisted pouch styles described within this document described above.

Accordingly, the pouch 17 is adapted to lay untwisted when the wrap 10 is in an extended position (as in FIG. 4) for maintaining a hairstyle or drying hair flat. Conversely, the pouch 17 is adapted to be twisted as shown at 23 in FIG. 6 and lifted toward the top section 14 to rest upon the cap portion and secured with the crown loop 44 and attachment means button 19 via loop 43 when the wrap 10 is in a wrapped position (as in FIGS. 5 and 6). Attachment means 43 may comprise an end elastic loop 43" which is preferably 0.001 to 2 inches wide located at the end of the pouch so that it can be fastened around the button to secure a twisted condition. It is on the end of the bottom section at the end of the pouch on all 4 head hair wrap caps. The button is located on all 4 wraps in 1-4 places for different styles options. The x-long wrap has a button option located in three 1-4 places; under the crown loop, a button on either the right or left side by the ear both above/below ear and a button underneath the base material loop. The long wrap has a button located in 1-4 places; at the middle of base as in the extra long wrap by the ear below and a button above the ear to the right or left side of head. On the medium wrap, the button is located in 1-3 places; at the center top of perimeter rim and underneath base material loop and by the ear to either the right or left side of head. The short wrap has a button located in 1-2 places; to the right or left of the head above the ear and underneath the crown material loop. The button or attachment can be changed to any desired placement and the wrap/cap will still be affective.

The twist comes from the pouch and the bottom section when twisted. It can be twisted to the right or to the left over shoulders, front center, down at the base, up then back down, down and the backup, to the right or left of head, at the top or bottom. It is dependent on the length of the wrap/cap (short, medium, long or extra long) on the desired style by wearer and then fastened on the button by the elastic end loop. The button can be located on the right side of the head or the left side of the head above the ear or by/below the ear, center of the perimeter rim, under the crown material loop or at the base underneath elastic of the pouch mouth opening in the middle. Any of the (4) wrap pouch can be twisted in a forward position and all the same applies in a backwards position. When worn in a forward position, the twist on (long wrap) goes up and over the back of head through the crown loop and is fastened on a right or left side button above the ear, or twisted in a rosebud over the right or left shoulder and fasten on button by the ear or center at base of pouch mouth opening. The twist on (medium wrap) goes over either the right or left shoulder in the shape of a donut and is fastened on the button with the elastic end loop located to the right or left side of head by the ear, back up over the head through the crown material loop and center the perimeter rim or as a rosebud at the base of the neck fastened on the button located at the base. The twist when pulled up over the head can also be repositioned to the right side of the head or left and for a better sleeping position.

The twist (short wrap) is twisted and rolled under and fastens on the button located under the crown material loop or to either side of the head to the right or left on the button located above the ear. The twist (x-long wrap) is either twisted at the base in a cinnamon bun shape and fastened on the button, with the elastic end loop being located at the side of the head to the right or left by the ear or up over the head through the crown material loop then back down the back of the head and fastened on the button located at the base or a cinnamon bon at the base of the neck and fastened on button located under crown material loop. The x-long wrap can be placed on the head backwards with the base at the front top of the head then the cinnamon bun on the top of the head. The x-long wrap uses the same side right or left side button by the ear or it can fasten on the button located under the base material loop and the crown material loop. Again, the long, medium and short wrap can also be worn in a backwards as described with this document as well.

The pouch drops off the base, which is located at the back hairline and at the top of the base of the neck generally 17 inches, and preferably 8.5 inches, with or without elastic. The mouth of the pouch is an enclosed opening into which substantially all of the hair is allowed to fall. This is a unique design which allows the hair there within to remain unconstructed, as in a traditional shower/bath cap or rain cap. The pouch can be worn untwisted as in FIG. 4 or twisted as in FIG. 5. The pouch allows the hair to flow naturally down off the neck while protecting the hair from water or moisture, which then also protects the hair and its shape even when well styled. This is the separate material underneath the bottom section of the head hair wrap cap. The solid top section, main body, side walls and bottom section are separate from this piece of material, which is defines the pouch and the opening attachment into which the hair is placed so that it lays flat on the back.

Elongated ties 30 are constructed having a proximal tie section 33 and a distal tie section 34 with an end 36. Proximal tie section 33 is attached to the perimeter rim 15 and side walls 18 and abut pouch mouth opening 17'. Between proximal tie section 33 and distal tie section 34 is a center body which preferably includes a bend, indent or knuckle 35. As best illustrated in FIGS. 7 and 8, a foam insert 32, or malleable material, is preferably inserted within ties 30 between knuckle 35 and distal tie section 34. The foam insert 32 is preferably not located between the proximal tie section 33 and knuckle 35. The foam insert 32 is positioned to give ties 30 more shape when the ties 30 are wrapped around the head. The foam can be omitted in ties, especially in the sleep or swim wrap/cap, and/or for men's wear. Foam insert 32 extends to a wire loop 37 that is located in end 36. Wire loop 37 is preferably rubber coated and is positioned inside the tie end 36 in a horse shoe shape. The wire loop 37 is only on the ends 36 so when the ties are tucked under, the wire in the ends 36 can be pinched around material for more security. Alternatively, the wire loop 37 may be omitted.

The hair wrap may be formed as a swim head/hair wrap that is composed of a water proof or non-permeable material having elastic properties. Examples of materials include rubber, latex and/or silicone or combinations thereof. Preferably, wherein the hair wrap is constructed as a swim hair wrap the crown material loop located on the top section is a small loop (~0.5"-1.5") that is elastic and is stretched to expand to receive the pouch attachment located on the bottom edge of the pouch and contract to securely hold the pouch attachment in place. In turn, preferably the pouch attachment is a button or hook integrated within the non-permeable material at the bottom edge of the pouch. As the swim head/hair wrap is placed on the swimmer's head the perimeter rim, pouch mouth opening and ties operate in concert to snuggly tighten the wrap around the swimmers hair line so that no water can enter between the swim hair wrap and the user's head, keeping the swimmer's hair dry. The swim hair wrap is easier to place on the head of the swimmer than traditional swim caps, especially for swimmers with long and/or very thick hair.

Figure 2B:
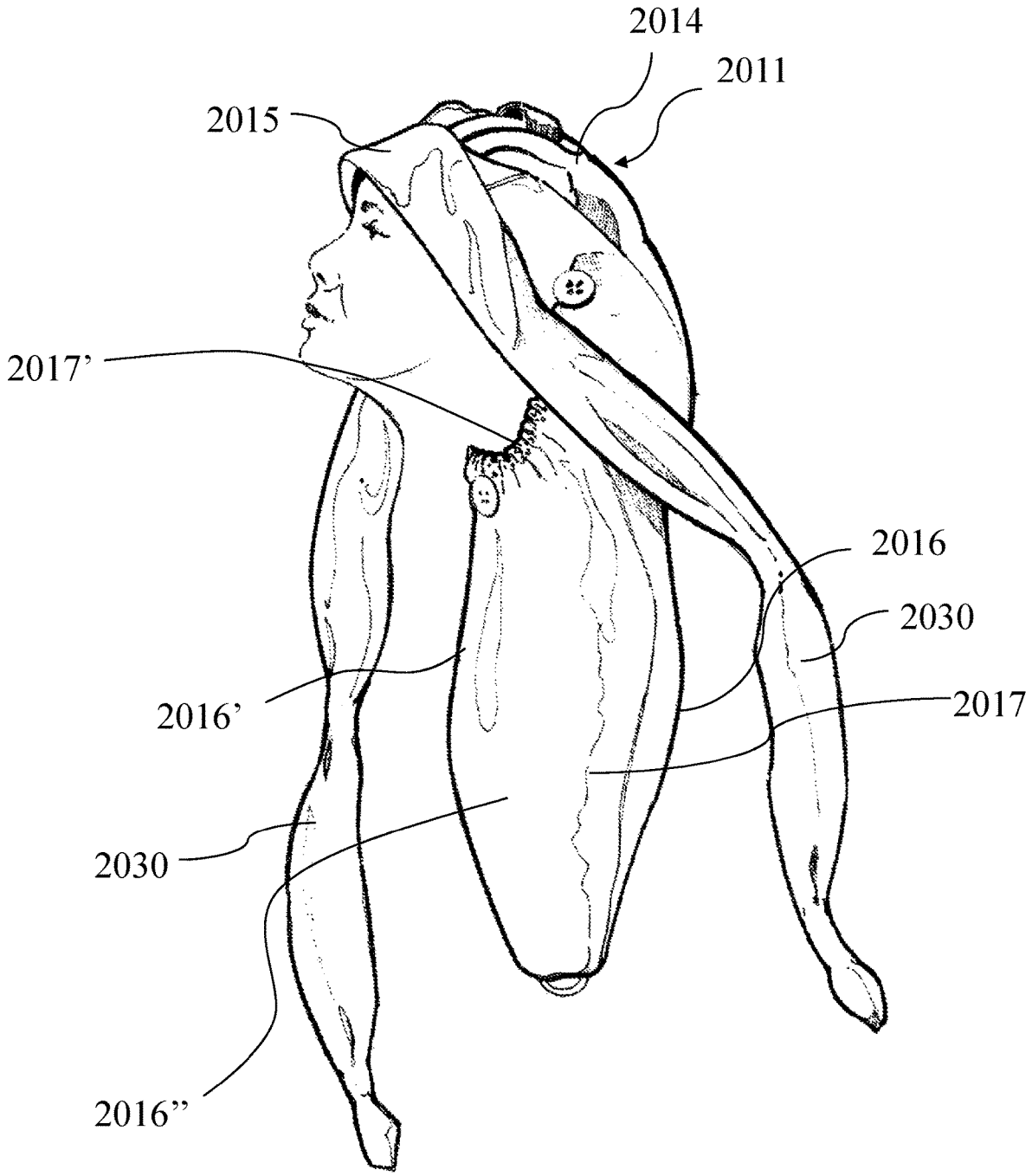
FIG. 2*b* is a side view of an alternative embodiment of the hair wrap of FIG. 1 where the ties are a continuation of the perimeter rim.

FIG. 2*b* is a side view of an alternative embodiment of the hair wrap of FIG. 1. In this embodiment, the ties are a continuation of the perimeter rim. The ties also may or may not include any type of knuckle or insert where as the foam and u-shape wirer are added. Main body 2011 has a top section 2014 formed as a cap portion with a perimeter rim 2015 extending to a bottom section 2016 having an elongated rim 2016'. An elongated sheet of material or interior wall 2016" is attached to or otherwise sewn along the entire elongated rim 2016' forming an elongated pocket or pouch 2017 enclosure having a top interior wall rim forming a pouch mouth opening 2017' attached to opposite ends of perimeter rim 2015. Elongated ties 2030 are formed as a continuation of the perimeter rim 2015.

Figure 2C:
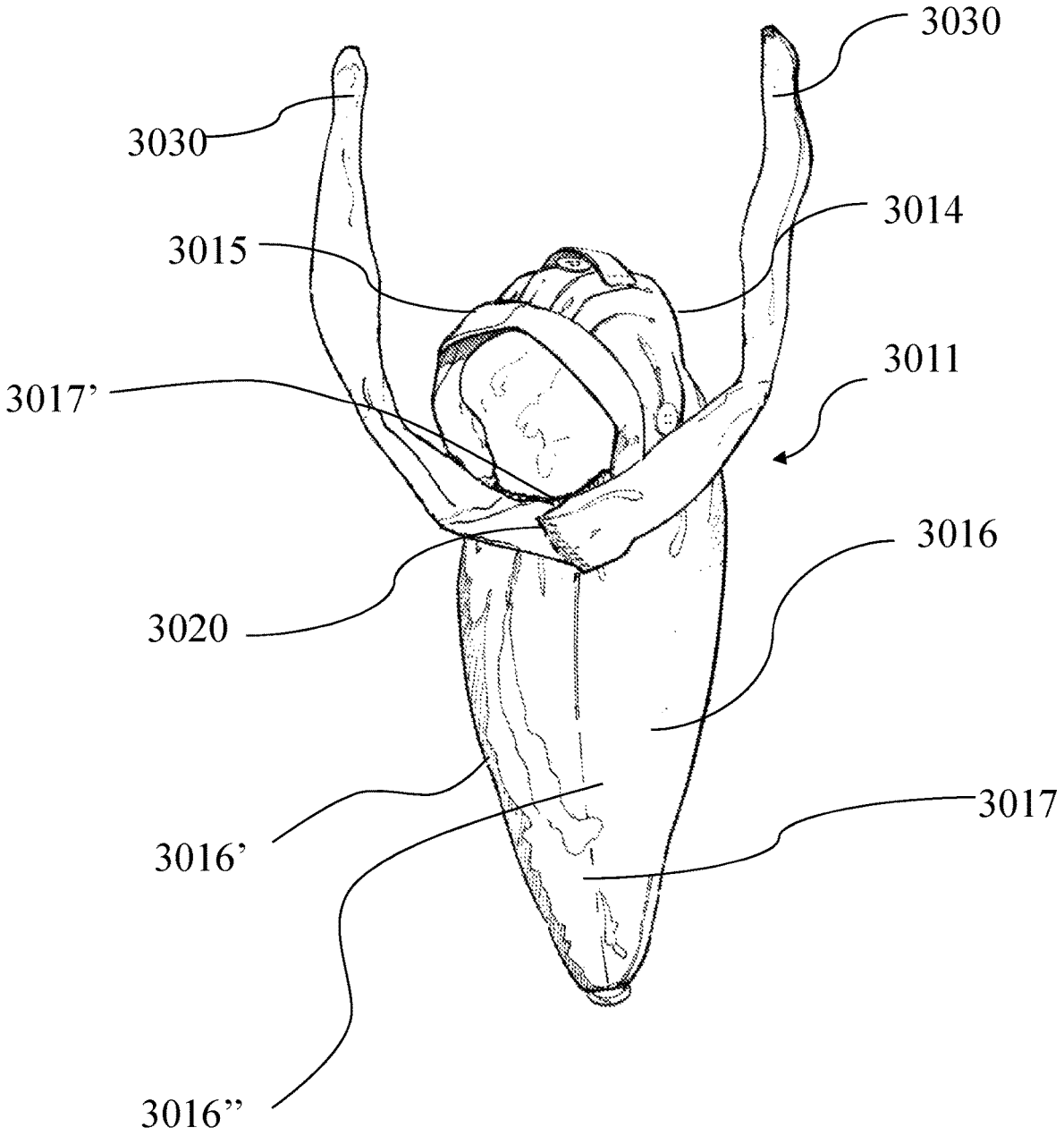
FIG. 2*c* is a front view of an alternative embodiment of the hair wrap of FIG. 1 where the ties are attached at the elastic base of the pouch mouth opening.

FIG. 2*c* is a front view of an alternative embodiment of the hair wrap of FIG. 1. In this embodiment the ties are connected with a seam under the pouch mouth opening. Main body 3011 has a top section 3014 formed as a cap portion with a perimeter rim 3015 extending to a bottom section 3016 having an elongated rim 3016'. An elongated sheet of material or interior wall 3016" is attached to or otherwise sewn along the entire elongated rim 3016' forming an elongated pocket or pouch 3017 enclosure having a top interior wall rim forming a pouch mouth opening 3017' attached to opposite ends of perimeter rim 3015. The perimeter rim 3015 edges terminate at and abut the edges of the pouch mouth opening 2017'. Elongated ties 3030 are formed along a central seam 3020.

When the wrap/cap is applied to the head the ties fall under the base of the neck and hair line. Meaning as in the new perimeter rim that gives more coverage on the forehead, the new ties at the base also lay on the back of the neck for more security from water entry. The ties are attached with a single seam up+down however the ties could also be sewn along the base elastic up both sides to the abutted to the perimeter rim. This design would be most ideal for a swim wrap/cap. Also in this design the pouch with 1 seam up the middle of pouch as well as the ties could only have 1 seam on them. The reason for 2 seams on the ties+pouch is for additional colors and material to be used to enhance the design style. If done in rubber for a swim cap there would be no seam through the wrap/cap for no water entry as in a swim cap. This is because the rubber can be molded not sewn together. Also the crown loop could be done as a small rubber loop to match rubber swim cap and to hold twist into place instead of an attachment means. The wrap/cap can have elastic only on the perimeter rim or only at the base of pouch opening. Also it can have elastic on both the elastic+base at the same time on design or no elastic on either the perimeter rim or base of the pouch mouth. If no elastic on wrap/cap then the design would rely on the ties to adjust fit to the head for security.

Figure 9:
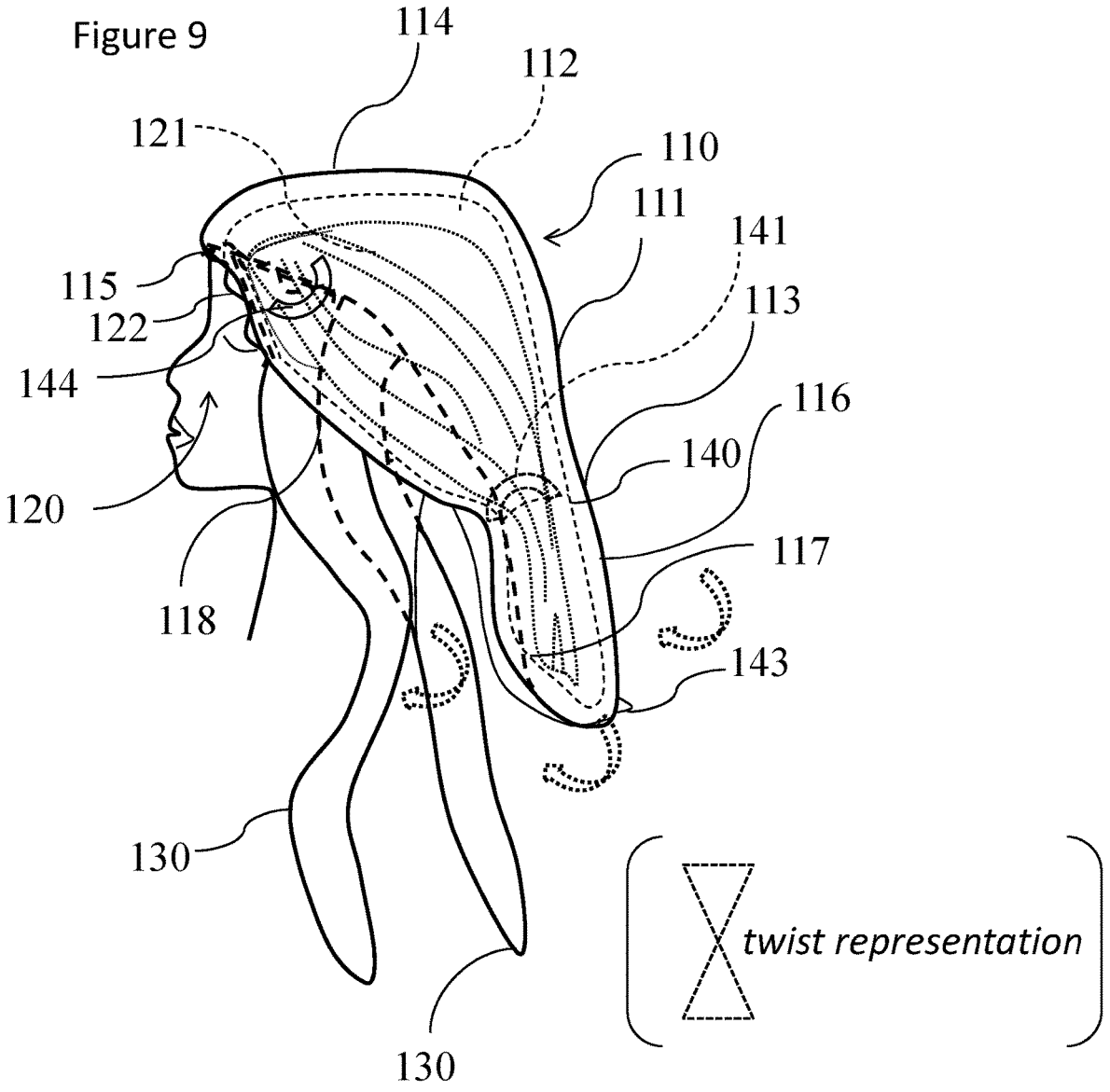
FIG. 9 illustrates another embodiment of the hair wrap, showing the wrap on a user's head wherein the wrap is placed on the head, but not yet wrapped and secured.
Figure 10:
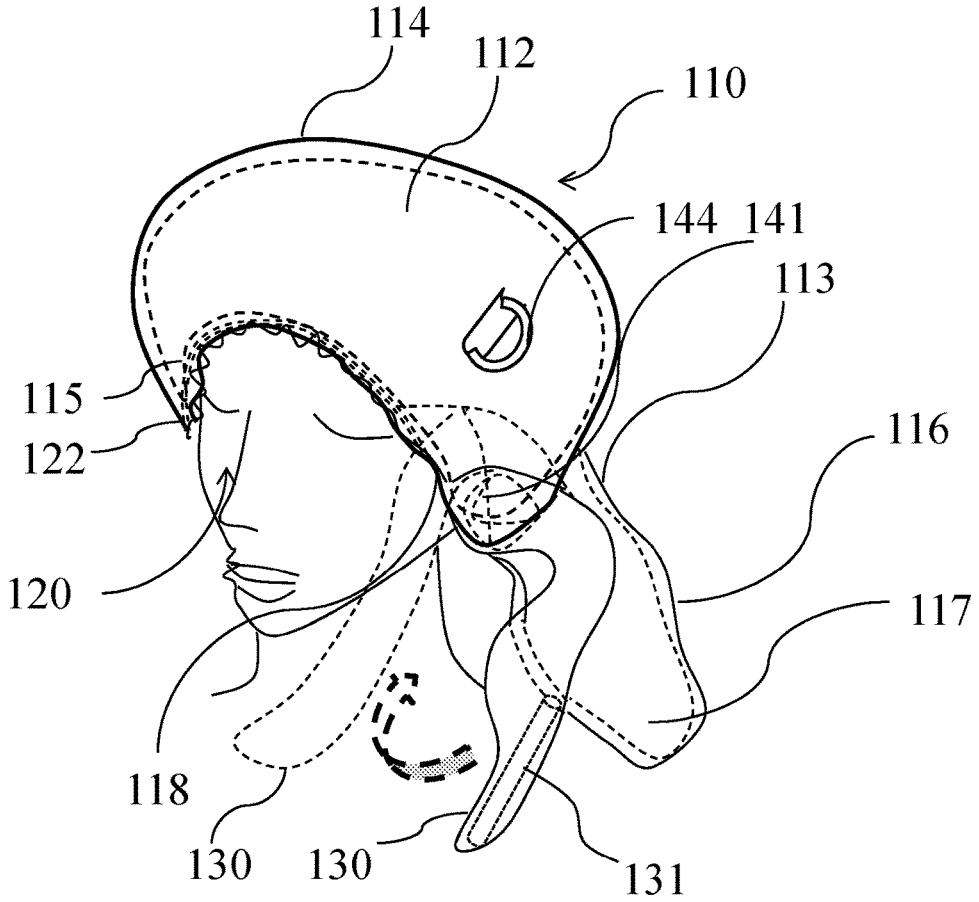
FIG. 10 illustrates the wrap of FIG. 9 wherein ties are secured, as in just before the bottom section of the wrap is twisted.
Figure 11:
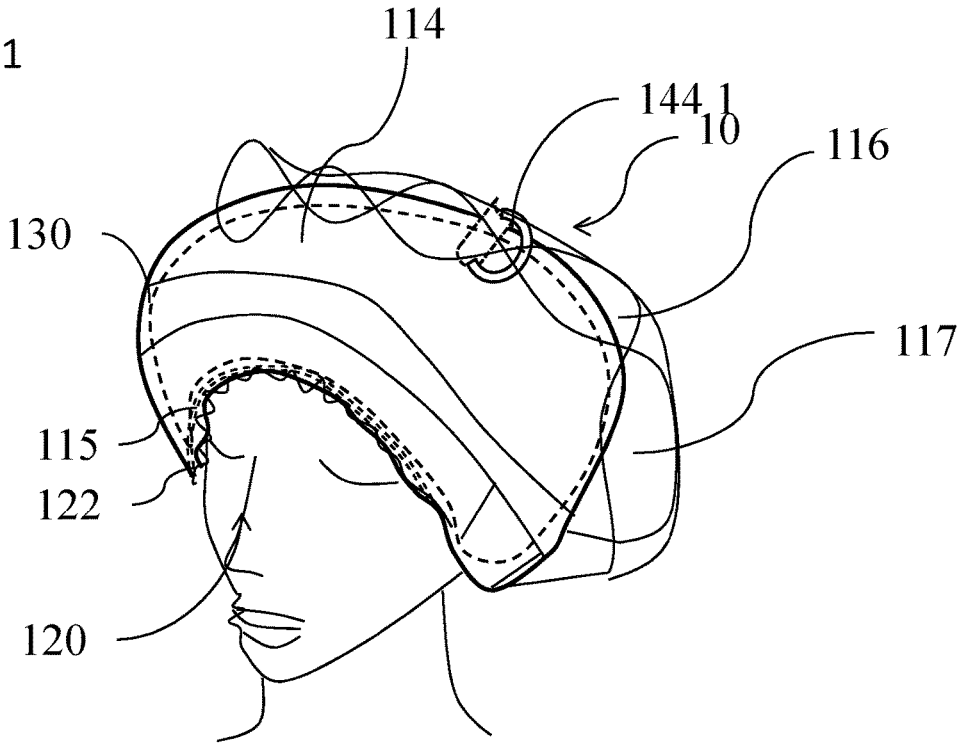
FIG. 11 illustrates the wrap of FIG. 9 secured to the head in a final configuration.

FIGS. 9-11 illustrate another embodiment of the hair wrap. FIG. 9 shows the wrap 110 on a user's head wherein the wrap is placed on the head, but not yet wrapped and secured. FIG. 10 illustrates the wrap 110 wherein ties are secured, as in just before the bottom section of the wrap is twisted. FIG. 11 shows the wrap 110 secured to the head in a final configuration.

Referring to FIGS. 9-11, the hair wrap is shown generally at 110. Wrap 110 generally comprises a main body 111 having an interior 112 and an exterior 113 formed having a top section 114 with a perimeter rim 115, a bottom section 116 forming a pouch 117, and side walls 118. Top section 114 is substantially formed as a cap portion appointed to fit a head and perimeter rim 115 is curved and includes a stretchable portion 122 (preferably, being an elastic band) preferably having at least one attachment means (preferably, being a button) [not shown]. The interior 112 is substantially lined with an absorbent material (preferably, being a terry cloth material; or other absorbing material). Alternatively, the interior 112 may be composed of a thermal material adapted to be chilled or heated to provide temperature treatment to the user. The exterior 113 is preferably composed of a water repellant/water impermeable material.

At least two elongated ties 130 are located on opposite sides of the side walls 118. Preferably, each of the ties includes foam with wire located in a bottom of the ties adapted to hold secure twist [see FIGS. 7, 8 at 32 and 37, respectively). The ties 130 are adapted to fall to sides of a users ears and are adapted to be pulled down and around then up over the user's head as depicted in FIG. 11. Ties 130 are adapted to be twisted in front of the top section 114 for securing the wrap 110 on the user's head and mitigating water entry to keep hair 121 dry and kempt/styled. A material loop 141 is located on a back base 140 of the pouch 117 and is adapted to hold ties 130 in place. The pouch 117 includes mating attachment means adapted to mate with the attachment means of the top section 114 (preferably, being an elastic loop adapted to receive the preferable button as shown at 143). The pouch 117 is adapted to lay untwisted when the wrap 110 is in an extended position (as in FIG. 9). On the other hand, pouch 117 is adapted to be twisted and lifted toward the top section 114 when the wrap 110 is in a wrapped position as shown in FIG. 11. A crown loop 144 is located on the top section 114 adapted to hold the pouch 117 after the pouch is twisted and lifted toward the top section 114.

Figure 12A:
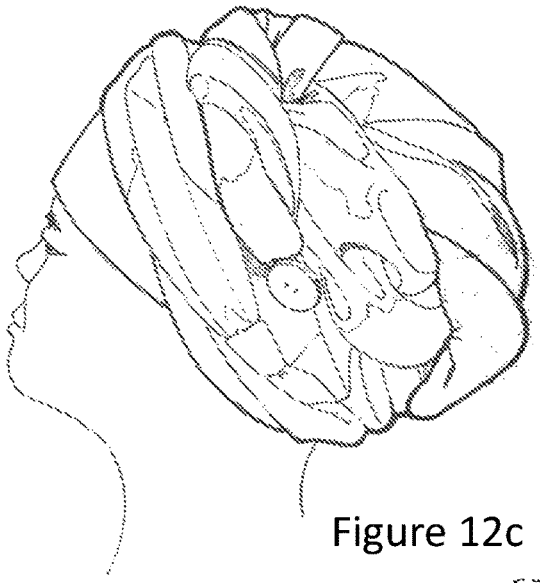
FIG. 12*a* illustrates the wrap cap in a forward position.
Figure 12B:
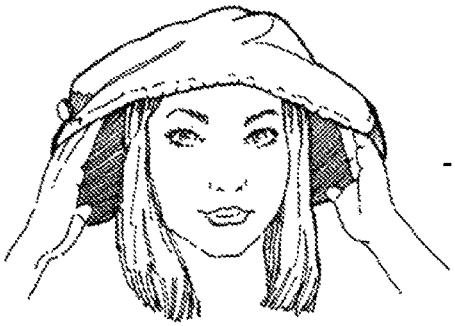
FIG. 12*b* illustrates step 1 of FIG. 12*a;*
Figure 12C:
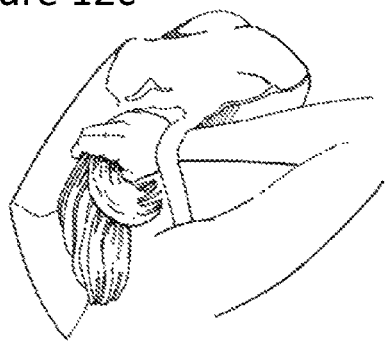
FIG. 12*c* illustrates step 2 of FIG. 12*a;*
Figure 12D:
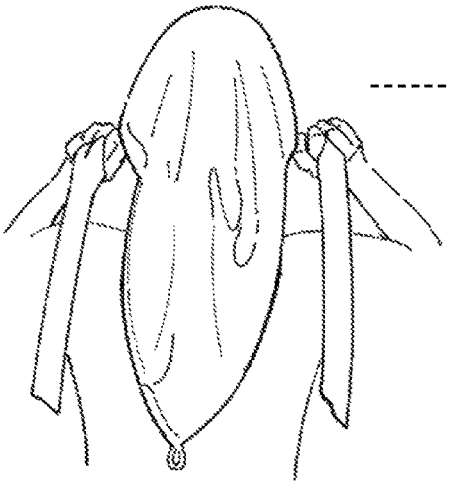
FIG. 12*d* illustrates step 3 of FIG. 12*a;*
Figure 12E:
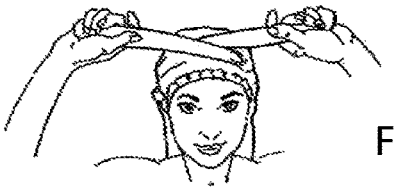
FIG. 12*e* illustrates step 4 of FIG. 12*a;*
Figure 12F:
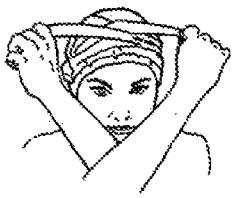
FIG. 12*f* illustrates step 4 further.
Figure 12G:
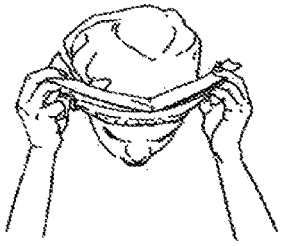
FIG. 12*g* illustrates step 4 of further.
Figure 12H:
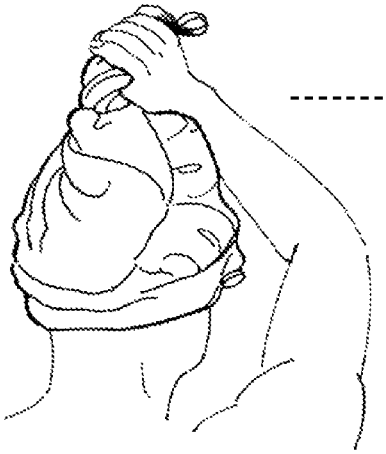
FIG. 12*h* illustrates a forward position.
Figure 12I:
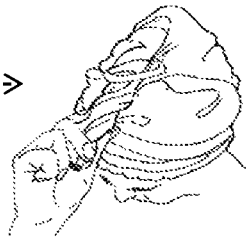
FIG. 12*i* illustrates step 6.
Figure 12J:
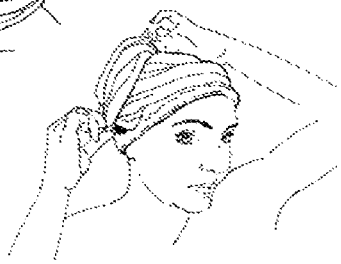
FIG. 12*j* illustrates step 6 further.

FIG. 11 illustrates the wrap of FIG. 9 secured to the head in a final configuration. FIGS. 12*a*-12*g* illustrates steps 1-4, showing six (6) basic steps to apply and construct the wrap cap. FIG. 12*a* illustrates the wrap cap in a forward position. FIG. 12*b* illustrates step 1 of FIG. 12*a*. FIG. 12*c* illustrates step 2 of FIG. 12*a*. FIG. 12*d* illustrates step 3 of FIG. 12*a*. FIG. 12*e* illustrates step 4 of FIG. 12*a*. FIG. 12*f* illustrates step 4 further. FIG. 12*g* illustrates step 4 of further. FIGS. 12*h*-12*j* illustrates steps 5-6, showing six (6) basic steps to apply and construct the wrap cap. FIG. 12*h* illustrates a forward position. FIG. 12*i* illustrates step 6. FIG. 12*j* illustrates step 6 further. Methods of use in wearing the hair wrap are illustrated in FIGS. 12*a*-15. The subject hair wrap method of use includes the following steps as illustrated in FIGS. 12*a*-12*j*, steps one through six (1-6): 1) place the wrap body over the head in a forward position with the pouch to the back; 2) place and tuck hair into the pouch; 3) pull both ties up over head to tighten the wrap and pull both ties up over or down under the head; 4) crisscross ties top of head, the ties are tied around each other and the ends are tucked under on opposite side; 5) twist pouch up over the back of head; 6) pull twisted pouch through crown material loop and fasten twist with elastic end loop on side button.

Figure 13A:
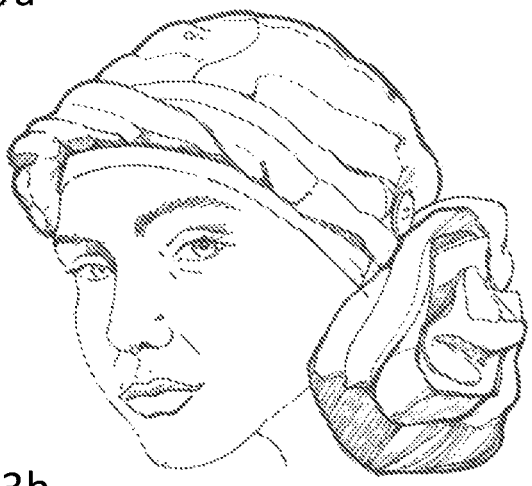
FIG. 13*a* illustrates a forward position final configuration.
Figure 13B:
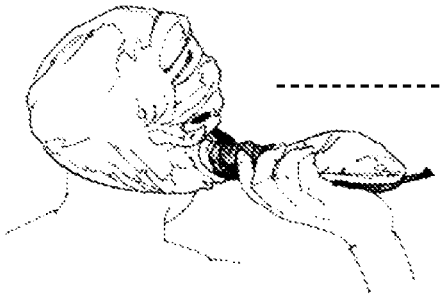
FIG. 13*b* illustrates step 1 of FIG. 13*a;*
Figure 13C:
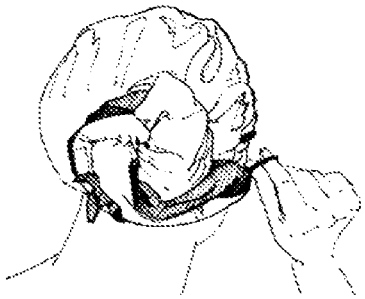
FIG. 13*c* illustrates step 2 of FIG. 13*a;*

FIG. 13*a* illustrates a forward position final configuration achieved by way of steps 1 and 2, as shown in FIGS. 13*b* and 13*c*, respectively. The hair wrap is positioned in the forward position with the pouch twisted and fastened to the side in a cinnamon bun configuration in an extra long wrap/cap. In step 1 the pouch is twisted to the side from the neck. In step 2 the pouch is spiraled around itself to create a cinnamon bun and fastened on the side button (See FIG. 1 at 19*a, b, c, d* . . . ). The long wrap can be styled in a rosebud configuration; the medium wrap can be styled as a donut configuration.

Figure 14A:
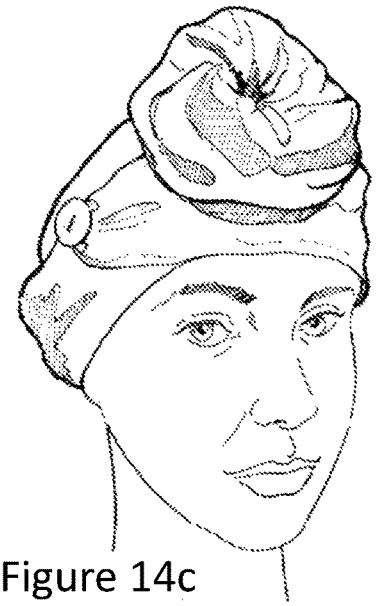
FIG. 14*a* illustrates a backward position final configuration.
Figure 14B:
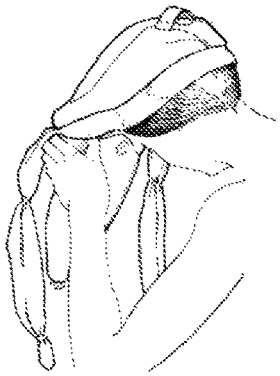
FIG. 14*b* illustrates step 1 of FIG. 14*a;*
Figure 14C:
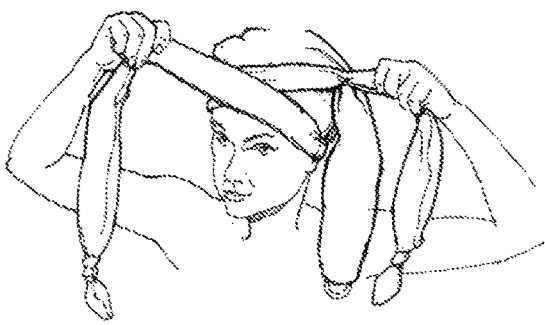
FIG. 14*c* illustrates step 2 of FIG. 14*a;*
Figure 14D:
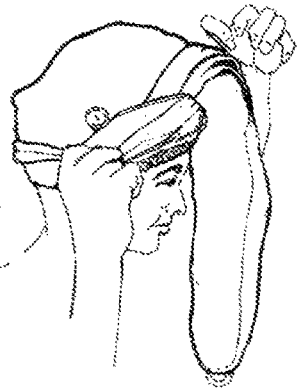
FIG. 14*d* illustrates step 3 of FIG. 14*a;*
Figure 14E:
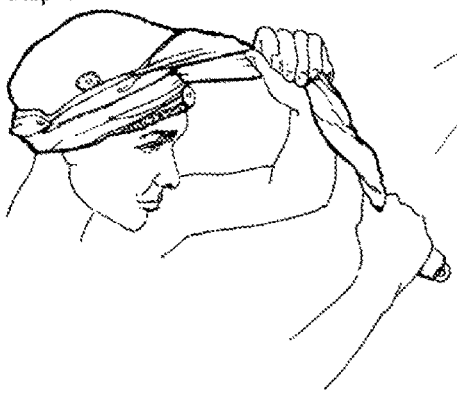
FIG. 14*e* illustrates step 4 of FIG. 14*a;*
Figure 14F:
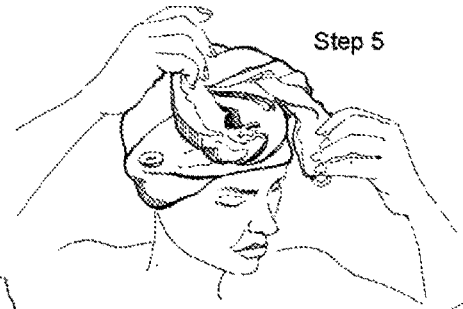
FIG. 14*f* illustrates step 5 of FIG. 14*a;*
Figure 14G:
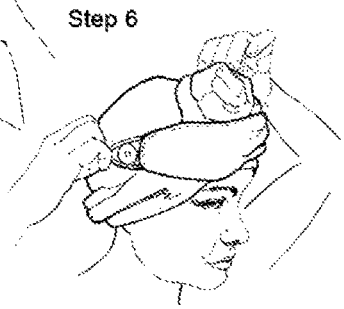
FIG. 14*g* illustrates step 6 of FIG. 14*a;*

FIGS. 14*a*-14*g* illustrate steps 1-6, showing six (6) basic steps to wear the wrap in a backwards configuration. FIG. 14*a* illustrates a backward position final configuration. FIG. 14*b* illustrates step 1 of FIG. 14*a*. FIG. 14*c* illustrates step 2 of FIG. 14*a*. FIG. 14*d* illustrates step 3 of FIG. 14*a*. FIG. 14*e* illustrates step 4 of FIG. 14*a*. FIG. 14*f* illustrates step 5 of FIG. 14*a*. FIG. 14*g* illustrates step 6 of FIG. 14*a*. The backwards wear configuration is shown with the pouch twisted in a cinnamon bun extra long wrap/cap. Step 1: place the wrap on a head with the elongated pouch and ties placed to the front. Step 2: pull up, crisscross the ties at the front of the head and pull back and tie the ties at the base. Step 3: tuck the ends under on opposite sides. Step 4: twist the pouch/elongated pouch. Step 5: swirl twisted pouch around into a cinnamon bun configuration. Step 6: fasten elastic loop end of elongated ties on side buttons. It is noted that long/longer elongated pouch constructions can be twisted in a rosebud configuration, while medium elongated pouch constructions can be twisted into a donut configuration.

Figure 15A:
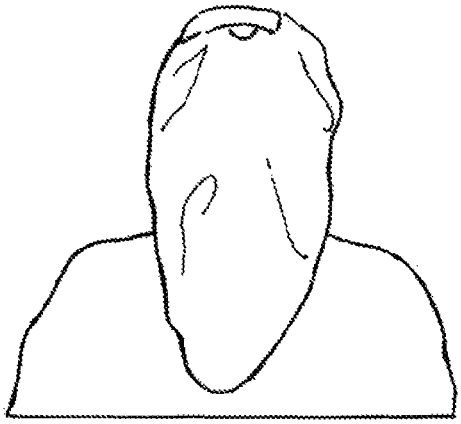
FIG. 15*a* illustrates a short wrap.
Figure 15B:
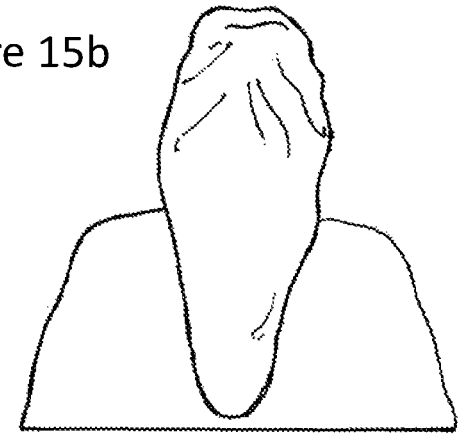
FIG. 15*b* illustrates a medium wrap.
Figure 15C:
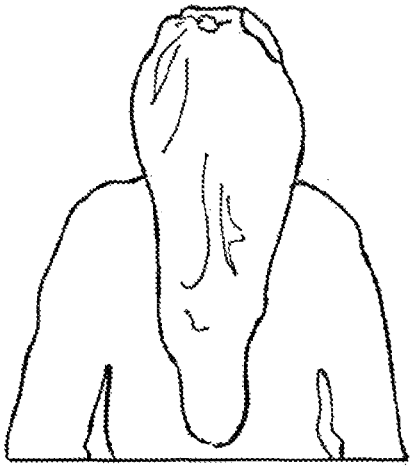
FIG. 15*c* illustrates a long wrap.
Figure 15D:
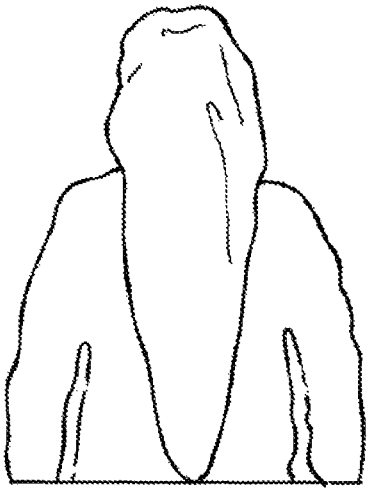
FIG. 15*d* illustrates an extra-long wrap.

FIGS. 15*a*-15*d* illustrate four (4) wraps (long, medium, short and extra long). FIG. 15*a* illustrates a short wrap. FIG. 15*b* illustrates a medium wrap. FIG. 15*c* illustrates a long wrap. FIG. 15*d* illustrates an extra-long wrap.

Figure 16:
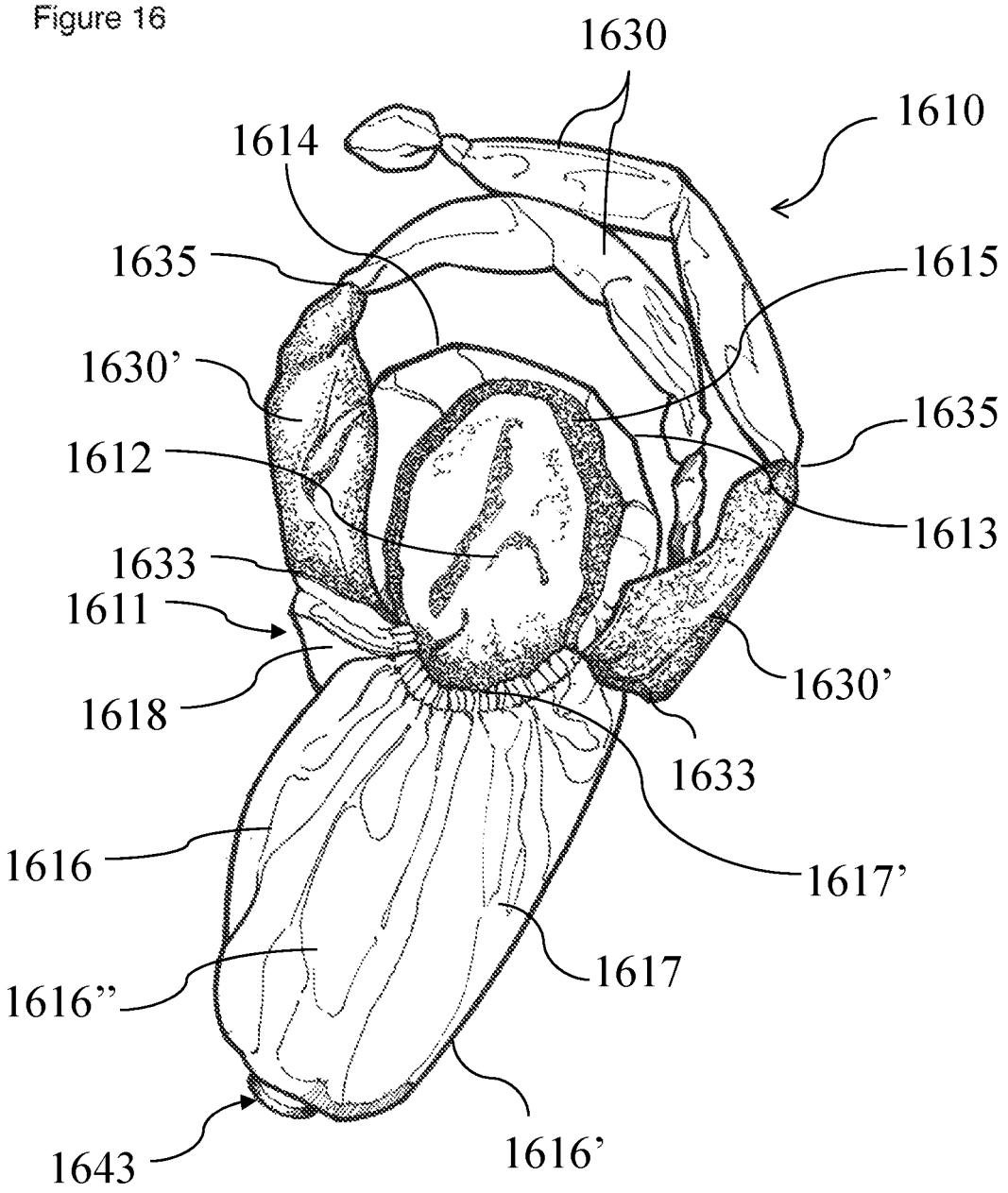
FIG. 16 shows a bottom plan view of the subject hair wrap, illustrating absorbent material place under perimeter rim and in the ties from top section to $1^{st}$ knuckle.

FIG. 16 shows a bottom plan view of the subject hair wrap, showing the perimeter rim with absorbent material underneath perimeter rim and ties to the 1$^{st}$ knuckle, pouch mouth opening, ties and underside of the elongated pouch in the forefront of the drawing. Hair wrap 1610 comprises a main body 1611 having an interior 1612 and an exterior 1613 as described herein. The wrap 1610 comprises a top section 1614 forming a "cap" and a bottom section 1616 forming an elongated pouch 1617. Top section 1614 has a perimeter rim 1615 and extends downward forming the bottom section 1616 having an elongated rim 1616'. An elongated sheet of material or interior wall 1616" is attached to or otherwise sewn along the entire elongated rim 1616' of bottom section 1616 thereby forming an elongated pocket or pouch 1617 enclosure having a top interior wall rim forming a pouch mouth opening 1617' attached to opposite ends of perimeter rim 1615 and side walls 1618 of bottom section 1616. At least two elongated ties 1630 are located and attached to opposite sides of the sidewalls 1618 and opposite ends of perimeter rim 1615. The pouch mouth opening 1617' extends between and abuts the side walls 1617 of bottom section 1616 and the perimeter rim 1615 of the top section 1614.

The top and bottom sections, perimeter rim, mouth opening and side walls are unilateral so that there are no gaps or openings between them, other than the opening for insertion of the head. Preferably, pouch mouth opening 1617' includes an elastic rim that extends completely therein so that it hugs the base or back of the head/neck so no moisture/water is allowed underneath and the hair will remain dry and kempt. Perimeter rim 1615 and pouch mouth opening 1617' abut and are attached to one another. Further, in this embodiment, preferably ties 1630 include a piece of absorbent material 1630' between the knuckle 1635 to proximal section 1633 on the underside adapted to touch the face—hairline interface, starting by the ears and wrapping around the back of the head over the elastic of the pouch mouth opening 1617'. Diaper cloth, terry cloth or any other sweat/moisture/water absorbing material can be used. The material can also be used under the perimeter rim 1615, which is adapted to touch the front of the head-hair line/forehead from below the ear to the other ear. As a result, the head-hairline is completely protected from any moisture migrating onto the hair. The same absorbent material may be used for interior wall 1616". As illustrated in this figure, the perimeter rim 1615 terminates at and abuts the edges of the pouch mouth opening 1617'. Loop 1643 is provided for securing the pouch on the head.

Figure 17:
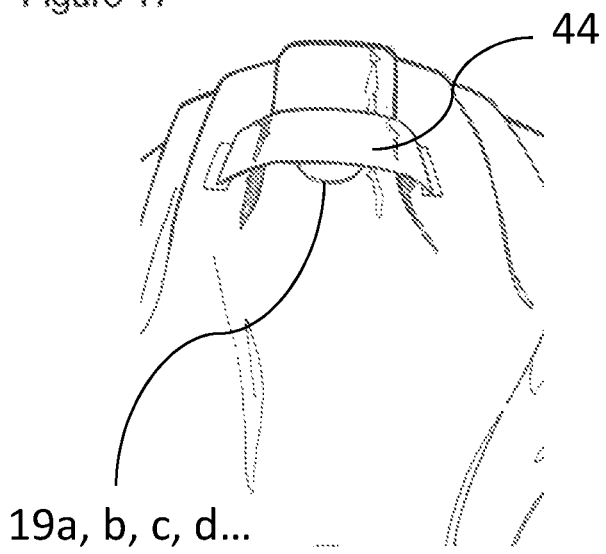
FIG. 17 shows a top aerial view of the hair wrap, showing the crown loop+crown loop button.

FIG. 17 shows a top aerial view of the hair wrap. This view shows the crown loop 44 located on the top section adapted to hold the pouch after it is twisted and lifted and placed on the top section. The crown loop is designed on all four (4) (short, medium long and the x-long wrap/cap combinations so even if not used as in the short it is used to hide the button underneath. However, the crown loop may be omitted on all four (4) wrap/cap combinations and the twist will still be functional. Crown loop button 19 (*a, b, c, d* . . . ) is shown located discretely under crown loop 44 for mating with attachment means (see FIG. 1 at 43) located on the bottom edge (see FIG. 1 at 43') of the pouch.

Figure 18:
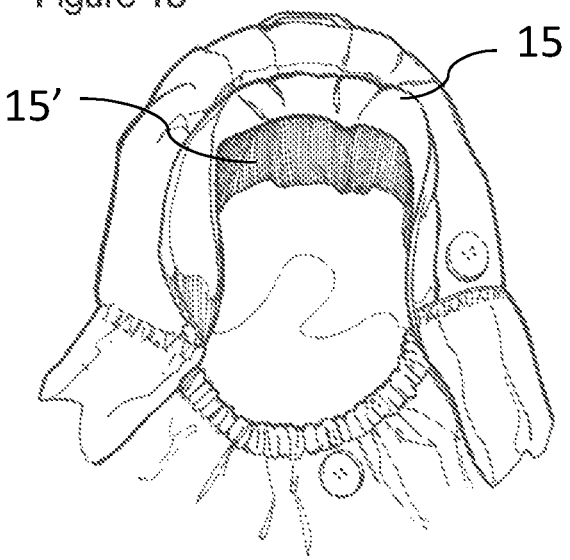
FIG. 18 illustrates a front partial view of the subject hair wrap, showing a strip of material as perimeter rim.
Figure 19:
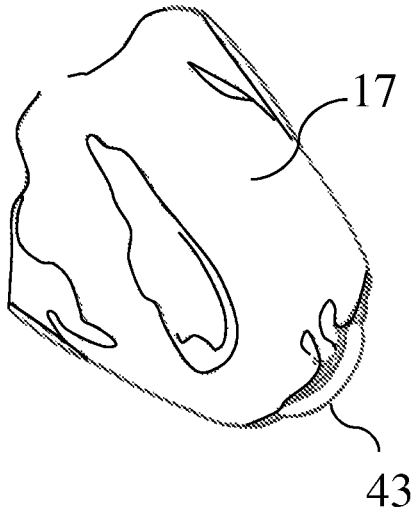
FIG. 19 shows a partial view of the elastic end loop attached on the elongated pouch.
Figure 20:
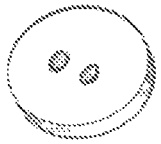
FIG. 20 shows an attachment means.

FIG. 18 illustrates a front partial view of the subject hair wrap. In the view of FIG. 18 an optional absorbent secondary perimeter rim 15' is shown located parallel to and abutting perimeter rim 15. FIG. 19 shows a partial view of the end of the elongated pouch. FIG. 20 shows an attachment means (19*a, b, c, d*) as a double hole button. Though a double hole button is shown, the button can also be a four-holed button. Generally, to keep costs down, two holes are more preferable.

Figure 21A:
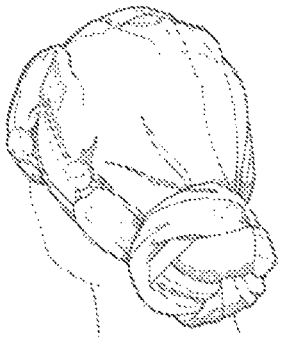
FIG. 21*a* illustrates an example of a way the hair wrap can be twisted and styled in a forward position/configuration.
Figure 21B:
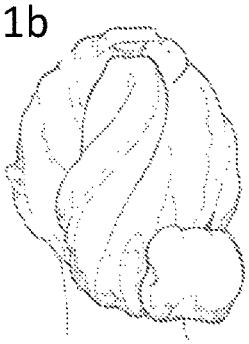
FIG. 21*b* illustrates an example of another way the hair wrap can be twisted and styled in a forward position/configuration.
Figure 21C:
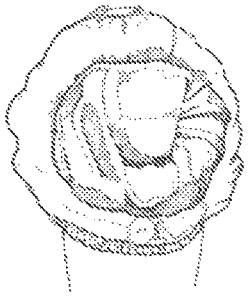
FIG. 21*c* illustrates an example of another way the hair wrap can be twisted and styled in a forward position/configuration.
Figure 21D:
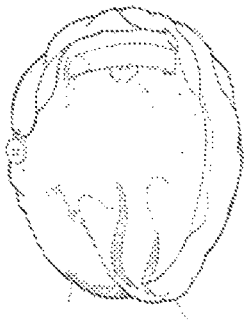
FIG. 21*d* illustrates an example of another way the hair wrap can be twisted and styled in a forward position/configuration.
Figure 21E:
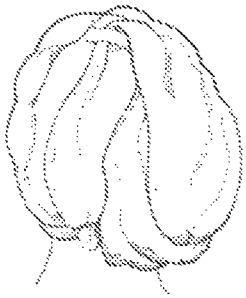
FIG. 21*e* illustrates an example of another way the hair wrap can be twisted and styled in a forward position/configuration.
Figure 21F:
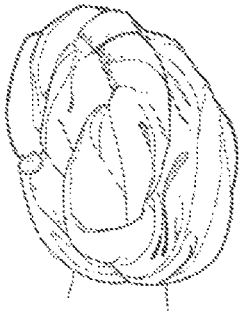
FIG. 21*f* illustrates an example of another way the hair wrap can be twisted and styled in a forward position/configuration.
Figure 21G:
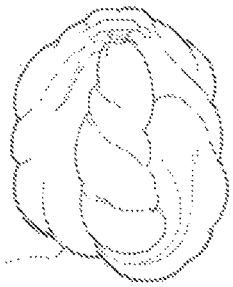
FIG. 21*g* illustrates an example of another way the hair wrap can be twisted and styled in a forward position/configuration.
Figure 21H:
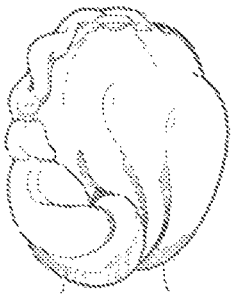
FIG. 21*h* illustrates an example of another way the hair wrap can be twisted and styled in a forward position/configuration.
Figure 21I:
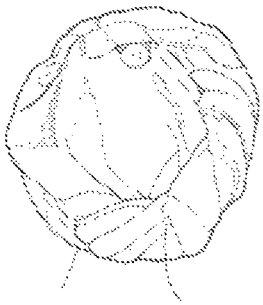
FIG. 21*i* illustrates an example of another way the hair wrap can be twisted and styled in a forward position/configuration.

FIGS. 21*a*-*i* illustrate examples of different ways the subject wrap described herein can be twisted and styled in the forward position/configuration as described herein. Each of the FIGS. 21*a*-*i* illustrate the wrap Length×Number as described in order. Wrap Length is represented as XL (extra-large), L (large), M (medium), or S (small). Position is shown in each of the FIGS. 21*a*-*i*. Number represents #1, #2, etc. . . . are the order the twist styles are described herein. For example, XL is shown in FIGS. 21*a, b, c, d* and *e*; M is shown in FIGS. 21*c, a, b* and *i*; L is shown in FIGS. 21*f, a* and *c*; S is shown in FIGS. 21*g* and *h*. FIG. 21*a* illustrates the forward configuration for: XL #1; M #2; L #2. FIG. 21*b* illustrates the forward configuration for: XL #2; M #3. FIG. 21*c* illustrates the forward configuration for: XL #3; M #1; L #3. FIG. 21*d* illustrates the forward configuration for: XL #4. FIG. 21*e* illustrates the forward configuration for: XL #5. FIG. 21*f* illustrates the forward configuration for: L #1. FIG. 21*g* illustrates the forward configuration for: S #1. FIG. 21*h* illustrates the forward configuration for: S #2. FIG. 21*i* illustrates the forward configuration for: M #4.

Figure 22A:
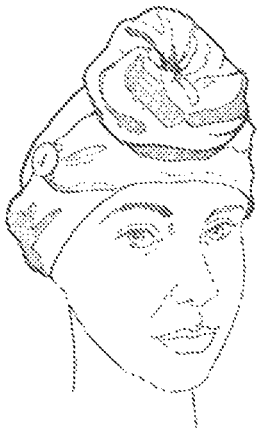
FIG. 22*a* illustrates an example of a way the hair wrap can be twisted and styled and worn in the backward position/configuration.
Figure 22B:
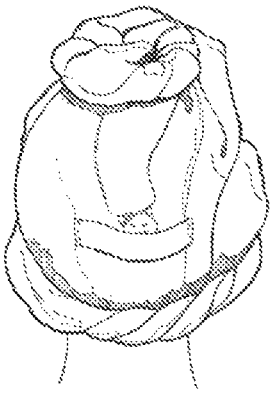
FIG. 22*b* illustrates an example of another way the hair wrap can be twisted and styled in a backward position/configuration.
Figure 22C:
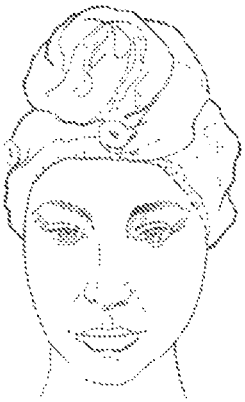
FIG. 22*c* illustrates an example of another way the hair wrap can be twisted and styled in a backward position/configuration.
Figure 22D:
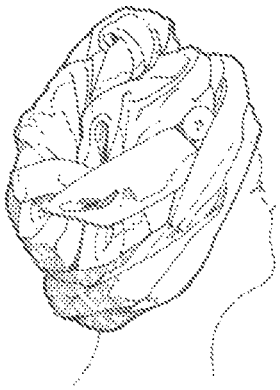
FIG. 22*d* illustrates an example of another way the hair wrap can be twisted and styled in a backward position/configuration.
Figure 22E:
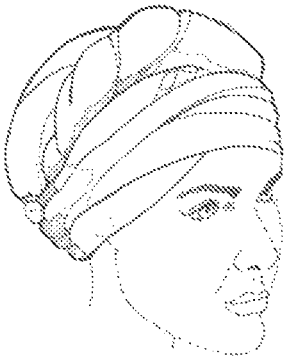
FIG. 22*e* illustrates an example of another way the hair wrap can be twisted and styled in a backward position/configuration.
Figure 22F:
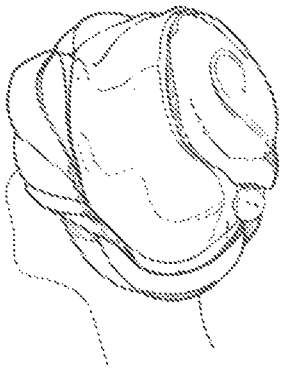
FIG. 22*f* illustrates an example of another way the hair wrap can be twisted and styled in a backward position/configuration.

FIGS. 22*a-f* illustrates examples of different ways the subject wrap described herein can be twisted and styled and worn in the backward position/configuration as described herein. Each of the FIGS. 22*a-f* illustrate the wrap Length× Number as described in order. Wrap Length is represented as XL (extra-large), L (large), M (medium), or S (small). Position is shown in each of the FIGS. 22*a-f*. Number represents #1, #2, etc. . . . are the order the twist styles are described herein. For example, XL is shown in FIGS. 22*a, b, c*; M is shown in FIGS. 22*c* and *b*; L is shown in FIGS. 22*b* and *d*; S is shown in FIGS. 22*e* and *f*. FIG. 22*a* illustrates the backward configuration for: XL #1. FIG. 22*b* illustrates the backward configuration for: XL #2; M #2; L #1. FIG. 22*c* illustrates the backward configuration for: XL #3; M #1. FIG. 22*d* illustrates the backward configuration for: L #2. FIG. 22*e* illustrates the backward configuration for: S #1. FIG. 22*f* illustrates the backward configuration for: S #2.

Figure 23A:
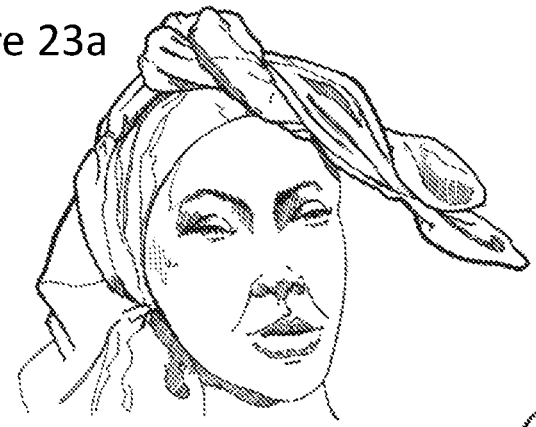
FIG. 23*a* illustrates an additional configuration to wear the elongated ties of the subject invention.
Figure 23B:
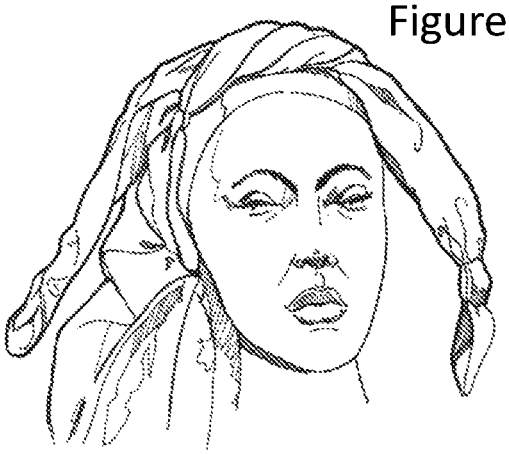
FIG. 23*b* illustrates another configuration to wear the elongated ties of the subject invention.
Figure 23C:
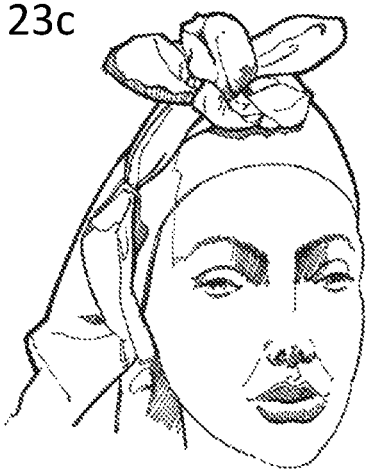
FIG. 23*c* illustrates another configuration to wear the elongated ties of the subject invention.
Figure 23D:
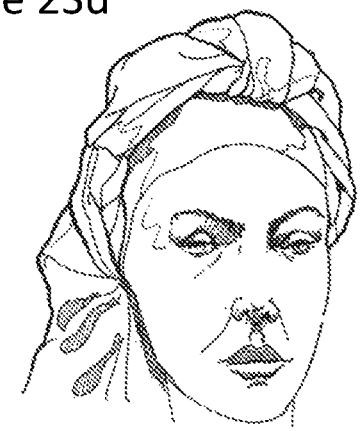
FIG. 23*d* illustrates another configuration to wear the elongated ties of the subject invention.

FIGS. 23*a-d* illustrates additional configurations to wear the elongated ties of the subject invention. The user/wearer can customize the fit of the wrap based on their style and head size. If the users head is small, then for example, the wearer may need to use the configuration shown in FIG. 23*d*. In this manner the ties are shortened when knotted then tucked under on either or both sides. FIG. 23*a* illustrates the forward position/configuration with the ties tied on the top of the head, then the ties are twisted together and tucked to either the right or left side of the head. The ties could also be twisted together and then around to form a knot with the ends of the ties tucked under the knot. FIG. 23*b* illustrates the forward position when the ties cross at the back of the neck, then are pulled back up over the head on opposite sides, tied at the top of the head and then tucked under on the opposite sides for security. FIG. 23*c* illustrates the forward position when the ties are knotted 2-3 times with the ends of the ties not tucked so they create a design that is part of the knot style. FIG. 23*d* illustrates the forward position with the ties knotted one time, still leaving the ties free to be tucked under both the right and left side. It is noted that the different ways to tie the ties can also be done when the wrap cap is in a backward position/configuration.

Figure 24A:
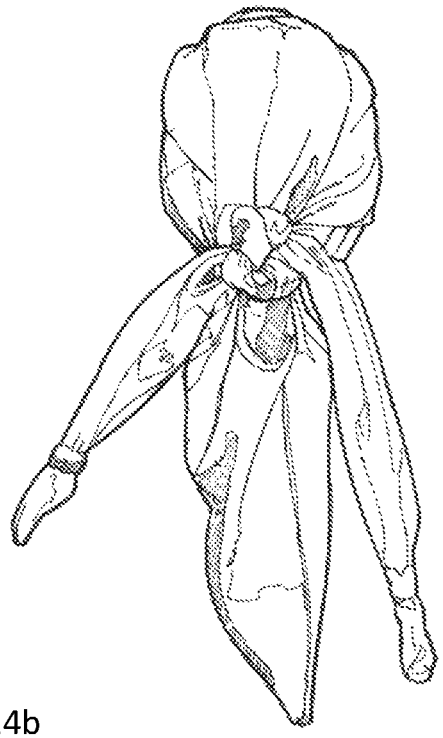
FIG. 24*a* illustrates the wrap in the forward position with the ties tied and knotted on the top of the pouch as the base of the neck.
Figure 24B:
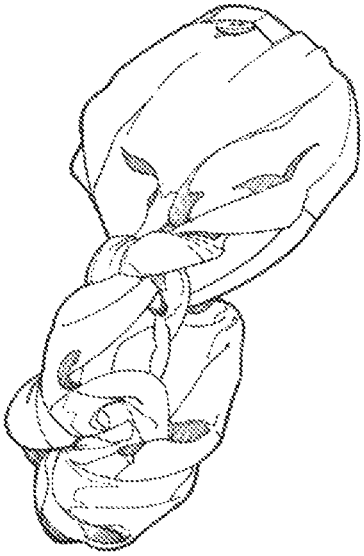
FIG. 24*b* illustrates the forward position with the ties tied on the top of the pouch at the base of the neck, and then the ties are twisted around the pouch and tucked under.
Figure 24C:
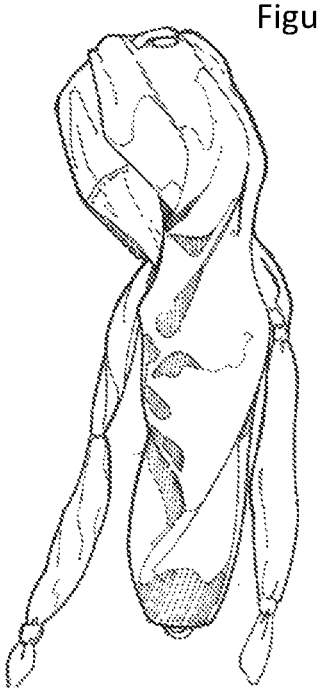
FIG. 24*c* illustrates the forward position with the ties tied at the base of the neck under the pouch however the ties could be lifted up over the head then tied+tucked under.

FIGS. 24*a-c* illustrates the wrap with the pouch undone. The pouch does not have to be twisted in order to be functional. This style would be more appealing form men's use or when worn under a helmet. The undone style is a way to wear the wrap if in a rush when showering or when stepping outside in bad weather, such as rain or snow. The undone pouch allows the hair to hang loose within the pouch so the hair is well kempt. FIG. 24*a* illustrates the forward position with the ties tied and knotted on the top of the pouch as the base of the neck. FIG. 24*b* illustrates the forward position with the ties tied on the top of the pouch at the base of the neck, and then the ties are twisted around the pouch and tucked under. The pouch is then lifted under itself and fastened with the elastic loop end onto the button at the base of the pouch mouth opening. FIG. 24*c* illustrates the forward position with the ties tied at the base of the neck under the pouch however the ties could be lifted up over the head then tied+tucked under.

Figure 25A:
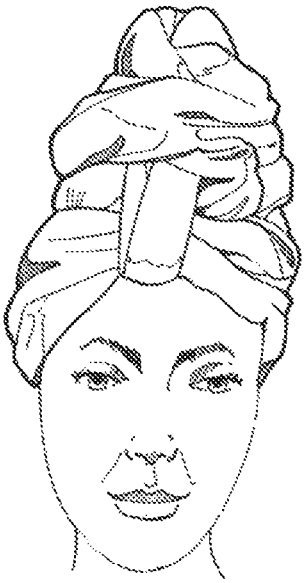
FIG. 25*a* illustrates an XL and/or L wrap cap in a backward position with the pouch twisted on the top of the head and fastened on the crown loop button with the ties tied, knotted and wrapped around the pouch going up to look like a volcano.
Figure 25B:
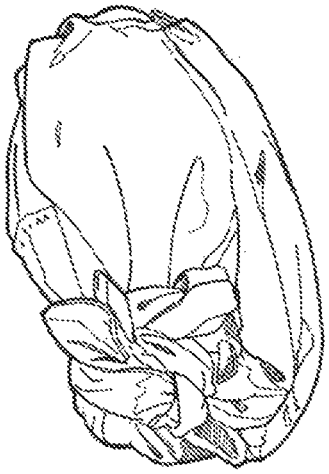
FIG. 25*b* illustrates an XL, L and/or M wrap cap in a forward position with the ties tied under the pouch at the base and tied and knotted on top of the pouch.
Figure 25C:
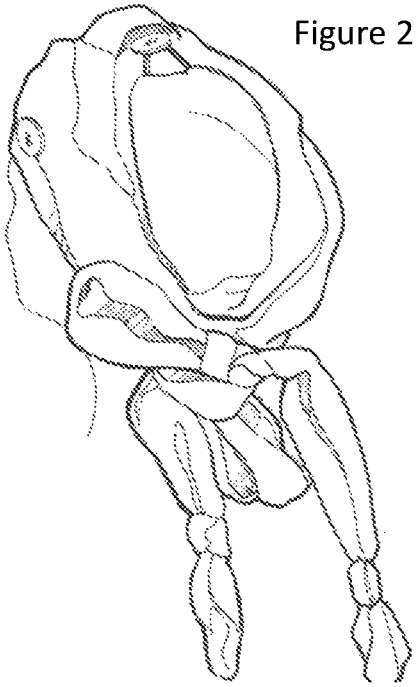
FIG. 25*c* illustrates an XL, L and/or M wrap in the forward position with the pouch twisted, lifted up over the back of the head and fastened on the crown loop button.
Figure 25D:
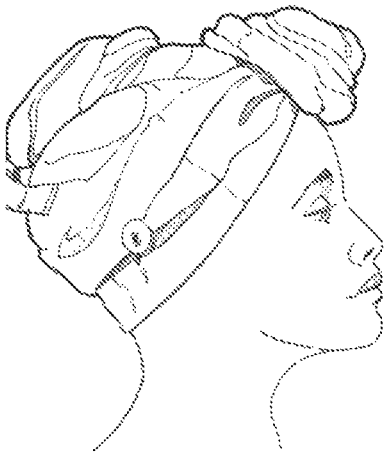
FIG. 25*d* illustrates an XL and/or L wrap cap in the backwards position with the pouch twisted back over the head and fastened at the crown loop button.

FIGS. 25*a-d* illustrates non-limiting examples of styles the head hair wrap can be arranged/worn. FIG. 25*a* illustrates an XL and/or L wrap cap in a backward position with the pouch twisted on the top of the head and fastened on the crown loop button with the ties tied, knotted and wrapped around the pouch going up to look like a volcano. FIG. 25*b* illustrates an XL, L and/or M wrap cap in a forward position with the ties tied under the pouch at the base and tied and knotted on top of the pouch. The pouch is then lifted over the side of the head and fastened on with the crown loop button. FIG. 25*c* illustrates an XL, L and/or M wrap in the forward position with the pouch twisted, lifted up over the back of the head and fastened on the crown loop button. The ties are then tied at the base of the neck in a bow. FIG. 25*d* illustrates an XL and/or L wrap cap in the backwards position with the pouch twisted back over the head and fastened at the crown loop button. The ties are then tied at the front of the head and twisted into a spiral shape. These are just a few examples of alternative ways to wear the head hair wrap cap. However, a person may find their own personal way to style the wrap cap. The possibilities are endless owing to the structure of the subject hair wrap.

Figure 26A:
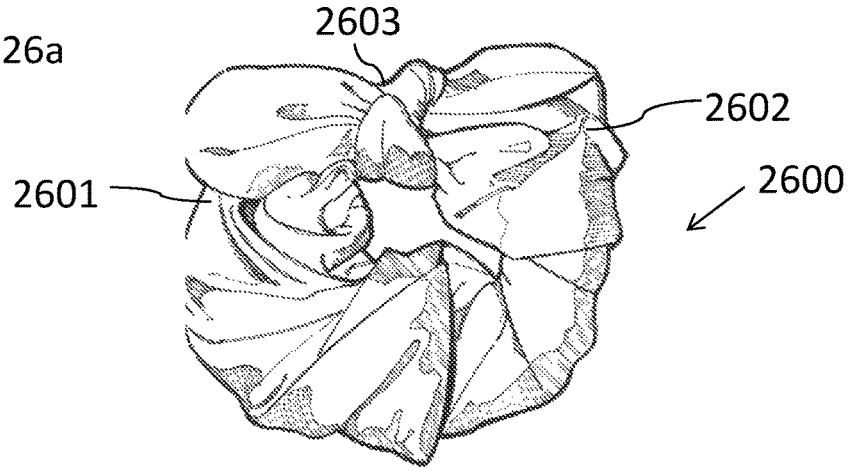
FIG. 26*a* illustrates an embodiment of an elastic band.
Figure 26B:
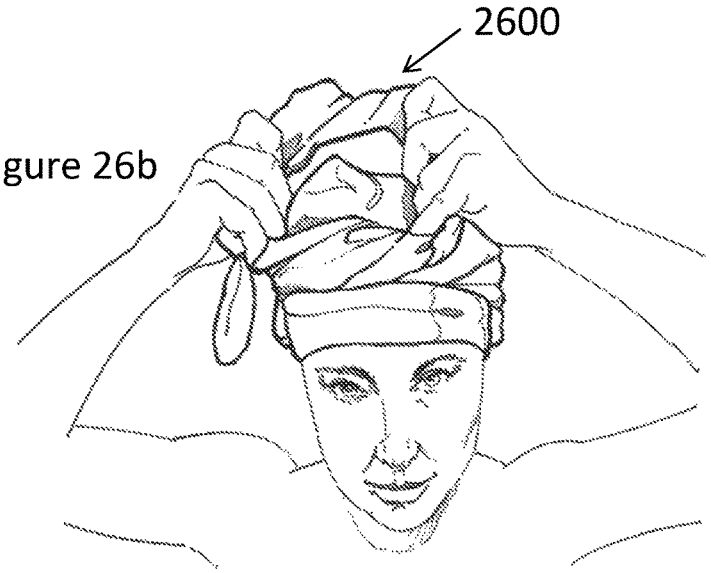
FIG. 26*b* illustrates how to place the elastic band around the twist stretched over the twisted pouch (donut (M), rosebud (L), cinnamon bun (XL))
Figure 26C:
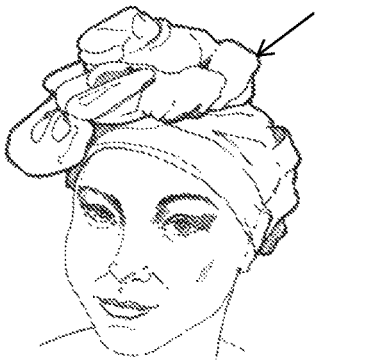
FIG. 26*c* illustrates the head hair wrap cap in a backwards position with the pouch twisted and the elastic band with (tie ends) attached placed over the twist to the side of the head above the ear on the button, either above or below the ear.
Figure 26D:
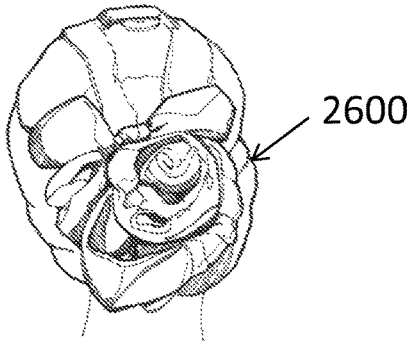
FIG. 26*d* illustrates the head hair wrap cap in a forward position with the pouch twisted at the back of the head with the elastic band (tie ends) attached and placed over the twist, and fastened on the base button.
Figure 26E:
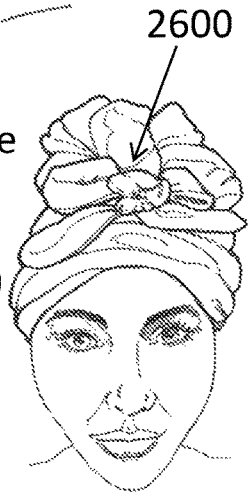
FIG. 26*e* illustrates the head hair warp cap in a backwards position with the pouch twisted on top of the head and the elastic band stretched over the twist which is fastened on the crown loop button.

FIGS. 26*a-e* illustrate an embodiment of elastic band, shown generally at 2600. The elastic band may be worn in conjunction with the hair wrap. Alternatively, the elongated tie ends are connected by way of a connection means at their distal end, such as by way of a piece of material tied around an elastic band to look like the ends of the elongated ties, so that the ties are interconnected. The elastic band resembles a unity ring type scarf. FIGS. 26*b-e* illustrates the elastic band of FIG. 26*a* worn with the subject hair wrap. The elastic band is generally constructed with matching material used for wrap/cap so it appears the twist is larger from a loose material having proximal and distal ends, 2601 and 2602, respectively, opposite from one another but attached by way of a connection means 2603. Connection means may be simply a knot as shown, or a clip. The material forming the elastic band may be composed of an elastic material, such as for non-limiting example, nylon, spandex, cotton, or combinations thereof. Alternatively, an elastic band may be located inside the loose material to provide stretching function to the elastic band. Tie ends are a piece of material tied around the elastic band to look like the ends of a scarf. The material may be removed if desired for a simpler look. The band is large enough to be stretched around the pouch when twisted into shape (donut, rosebud or cinnamon bun). This helps to better hold the twist into shape. Also, it allows for the wearer to embellish the twist by making it look fuller. Multiple bands can be used as well as multiple color of bands, to customize the wearer's wardrobe and personalized style. Tie ends are a piece of material tied around an elastic band to look like the ends of a scarf. This can be removed if desired for a simpler look. FIG. 26*b* illustrates how to place the elastic band around the twist stretched over the twisted pouch (donut (M), rosebud (L), cinnamon bun (XL)). FIG. 26*c* illustrates the head hair wrap cap in a backwards position with the pouch twisted and the elastic band with (tie ends) attached placed over the twist to the side of the head above the ear on the button, either above or below the ear. FIG. 26*d* illustrates the head hair wrap cap in a forward position with the pouch twisted at the back of the head with the elastic band (tie ends) attached and placed over the twist, and fastened on the base button. FIG. 26*e* illustrates the head hair warp cap in a backwards position with the pouch twisted on top of the head and the elastic band stretched over the twist which is fastened on the crown loop button. Tie ends is a small piece of material that is knotted around the elastic band to look like the ends of a scarf because the design of the wrap cap it to mimic a long scarf tied around the head. The small piece of material can be removed if desired. When referring to the pouch being twisted, the long wrap makes a rosebud, extra-long a cinnamon bun and medium makes a donut sized twist.

Figure 27A:
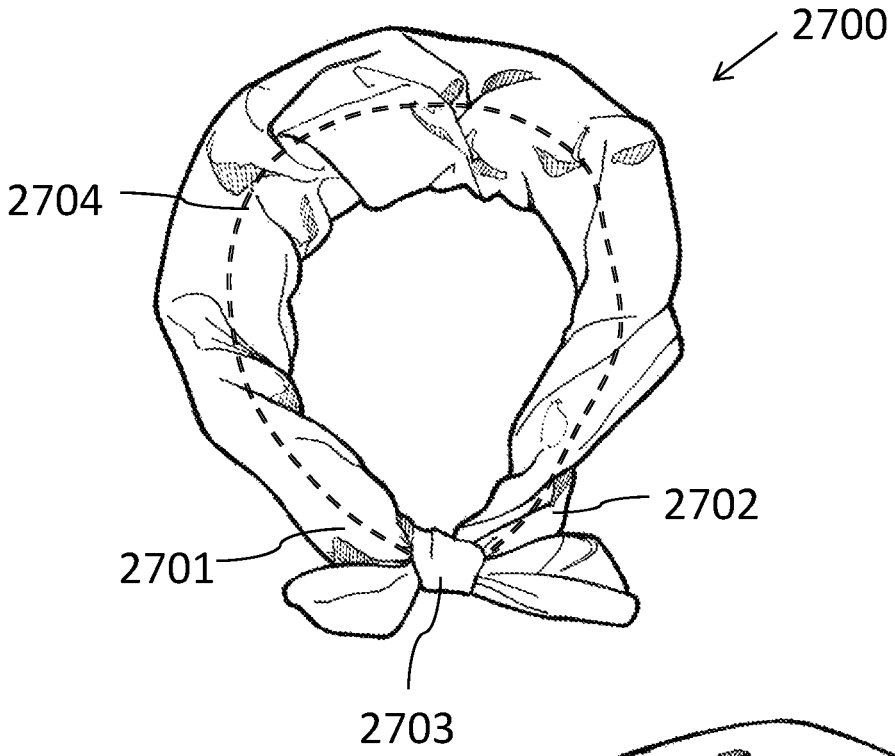
FIG. 27*a* illustrates a top plan view an embodiment of a crown band.
Figure 27B:
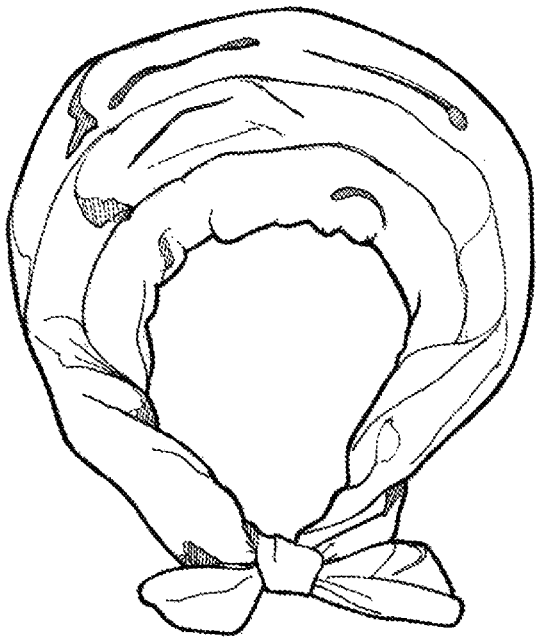
FIG. 27*b* illustrates the head band crown (3 tiers) applied over the head creating a crown effect.

FIGS. 27*a-b* illustrate an embodiment of a crown band, shown generally at 2700. The crown band may be worn in conjunction with the hair wrap. The crown band can be a single tier, two tiers, three tiers, or a plurality of tiers. FIG. 27*a* illustrates a top plan view of the crown band. The crown band is generally constructed from material that matches material used for wrap/cap so it looks like it's an extension of design a loose material around a large elastic that goes around the head having proximal and distal ends, 2701 and 2702, respectively, opposite from one another but attached by way of a connection means 2703. Connection means may be simply a knot as shown, or a clip. The material forming the crown band may be composed of an elastic material, such as for non-limiting example, nylon, spandex, cotton, or combinations thereof. Alternatively, an elastic band 2704 may be located inside the loose material to provide stretching function to the crown band. FIG. 27*a* illustrates the head band crown (1 tier) adapted to go over the head creating a crown effect as in a Gele head wrap (like worn by the women of Nigeria). FIG. 27*b* illustrates the head band crown (3 tiers) applied over the head creating a crown effect as in a Gele head tie which is known for it very large over sized way in which a piece of material is wrapped around the head. It is important to recognize that these types of head wrap take time+patients to learn how to execute properly which is why the head hair wrap/cap invention is so useful, user friendly and simplifies the head wrap ritual. Also a headscarf or material has no give and can be constraining around the head over time which is why having some elastic within the pouch mouth opening and or perimeter rim is good to give some space to breath as well as the ties can be tied loosely to create the desired fit around the head for comfort and again this does not disrupt the ability to keep the hair dry+well kempt.

Figure 28A:
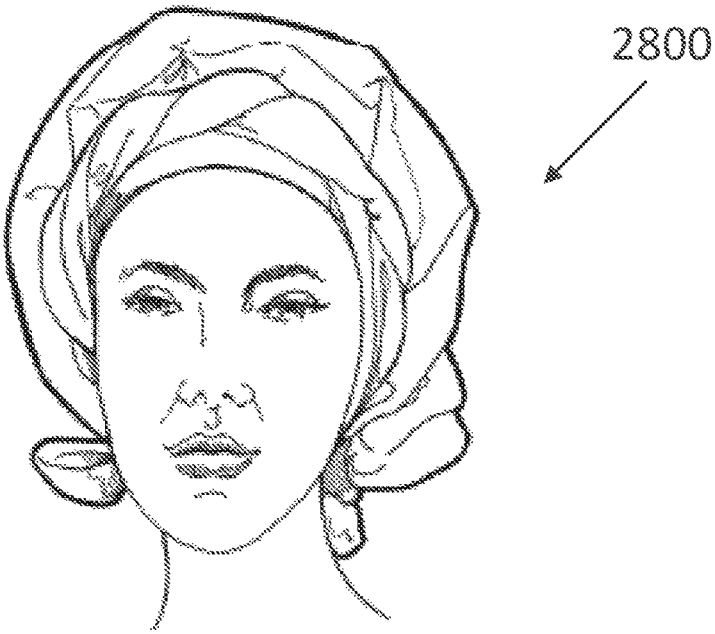
FIG. 28*a* illustrates an embodiment of a crown band worn with the hair wrap.
Figure 28B:
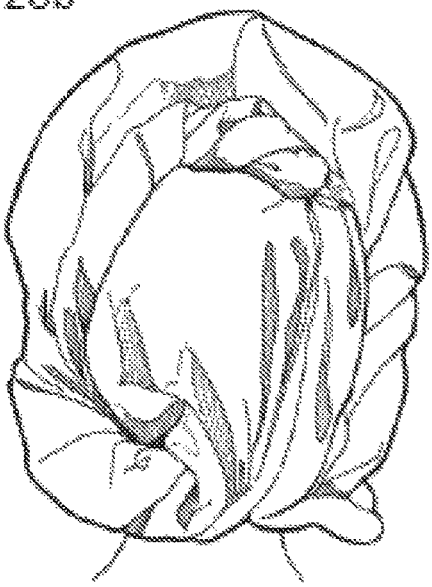
FIG. 28*b* illustrates a back view of the hair wrap in a forward position with the pouch twisted around the side and fastened on a side button with the crown band placed thereon.
Figure 28C:
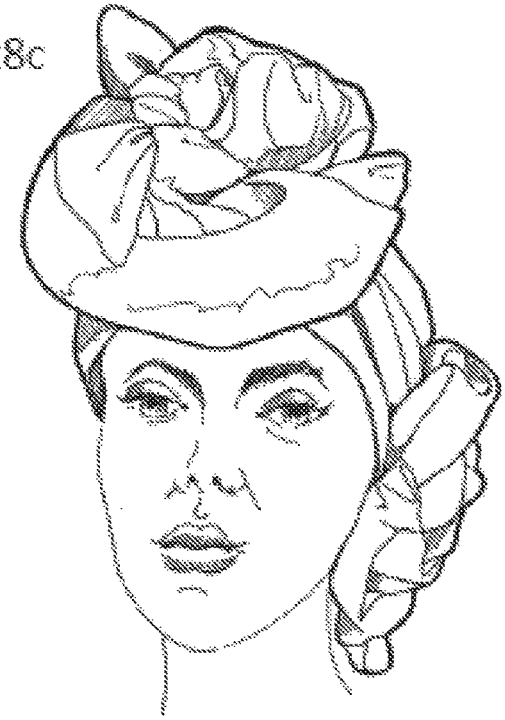
FIG. 28*c* illustrates the hair wrap in the backward position with the pouch twisted and fastened either on the base button or crown button.

FIGS. 28*a-c* illustrate an embodiment of the crown band worn with the hair wrap. FIG. 28*a* illustrates a front view of the hair wrap in a forward position with a one tier crown band, shown generally at 2800. The ties are wrapped around the head and fastened with the crown band placed behind the ties. This gives a fuller look as in a Gele head tie. FIG. 28*b* illustrates a back view of the hair wrap in a forward position with the pouch twisted around the side and fastened on a side button with the crown band placed thereon. FIG. 28*c* illustrates the hair wrap in the backward position with the pouch twisted and fastened either on the base button or crown button. Then the crown band is doubled up and stretched around the twist. The elastic band has been stretched and placed around the ties which were twisted into a knot to the side below the ear.

Figure 29A:
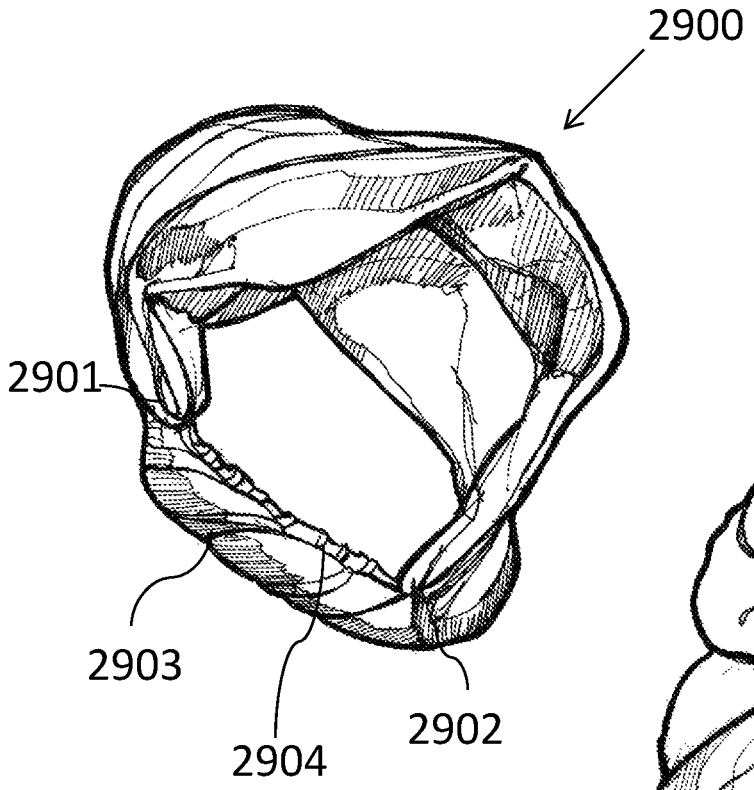
FIG. 29*a* illustrates an embodiment of a head band that can be worn alone or with the hair wrap.
Figure 29B:
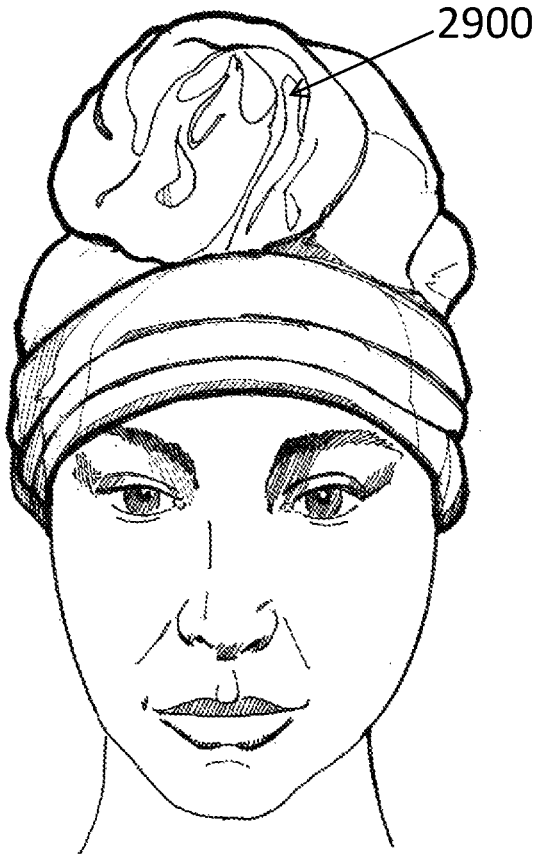
FIG. 29*b* illustrates the hair wrap in a backward position with the head band pulled up onto the wrap cap.

FIGS. 29*a-b* illustrates another embodiment of a head band/crown band of the subject invention, shown generally at 2900. FIG. 29*a* illustrates an embodiment of a head band that can be worn alone or with the hair wrap. The head band 2900 comprises a loose material section with a proximal end 2901 and a distal end 2902 connected by way of a connection means, such as an elastic band 2903. A piece of foam 2904 is inside the material is connected on an outer side to look like the shape of ties. Generally the head band is made of material that matches the material used in wrap/cap to again blend so it looks like a large scarf wrapped around the head. The head band can be worn around the head wrap cap. First the wrap cap is put on in a forward or backward position. Then the head band is pulled up from the neck onto the head over the wrap cap. The head band helps to give more security around the hairline at the perimeter rim and the pouch mouth opening. There is a small strip of elastic in the material to give stretch and also a piece of foam of about 1 inch to 2 inches in length may (or may not) be added. The foam, when added, gives shape so that it will blend with the foam in the ties. This gives the appearance of a scarf tied around the head and also helps the wrap cap to stay in place when working out.

FIG. 29*b* illustrates the hair wrap in a backward position with the head band pulled up onto the wrap cap. It is best to put the head band over the wrap cap onto the neck and then pull the head band up and over the wrap cap. The elastic portion can go to the front or the back of the head depending on the desired style. The head band can be worn with the wrap cap in a forward or backwards position. It is best when the head band is worn with the material on the back on the and over the ears. The elastic with foam on top of head between the two ties as demonstrated. The head band can be worn the other direction but best when material is to the back to give more security at and on the nape of the neck. The wrap cap, if worn for work out, could be done in a stretchable material as in spandex with and absorbent or hot/cold temperature regulating material for the interior and a moisture/sweat absorbent material under the perimeter rim+top section of ties to the 1$^{st}$ knuckle. The head band, elastic band+crown band would then be done in the same stretchable material to match the work out wrap/cap. Because the material is already stretchable the elastic in these bands would be omitted. The bands can also be done in a variety of colors and patterns so wearer can customize their wrap/cap to match their fashion and personal style. This is an example of how the head wrap hair cap can be designed to meet the needs or otherwise called (form follows function.) The same can then be applied to all other materials used if in terry cloth for salon+at home use, waterproof for rain, shower, bathing, indoor/outdoor activities use, blue jean, lace or cotton for fashion use, fur or faux fur for cold weather use, silk+satin for sleep or bridal use, leather or pleather for sports and etc. . . . to give a few examples of depending on how the wrap/cap is being worn determines the exterior and or no interior, if an interior what material to use, foam+wirer or no foam and u-shape wirer or one without the other, material under the perimeter rim+ties at the top section to the 1$^{st}$ knuckle or no material, bands, tie placement, the many ways the head wrap hair cap can be designed and customized. The head, elastic+head band again would coordinated with the materials used in the wrap/cap and for further personalization an ornament can be added that has been customized in a logo or decorative design. This is because of then unique design of the head wrap hair cap can have multiple use+functions.

Figure 30A:
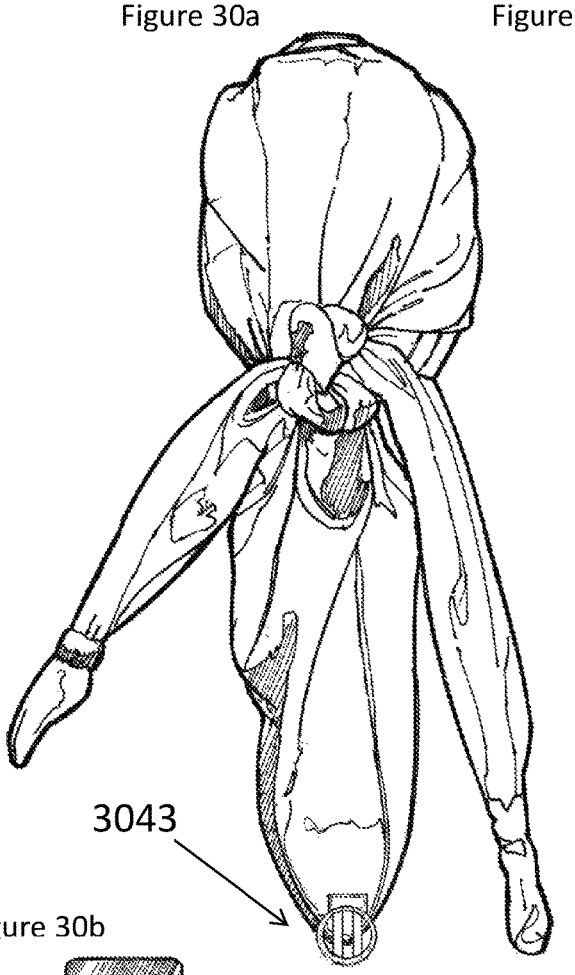
FIG. 30*a* illustrates a back view of the hair wrap with a wrap clip attachment.
Figure 30B:
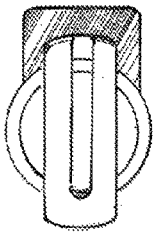
FIG. 30*b* illustrates the clip attachment of FIG. 30*a;*
Figure 30C:
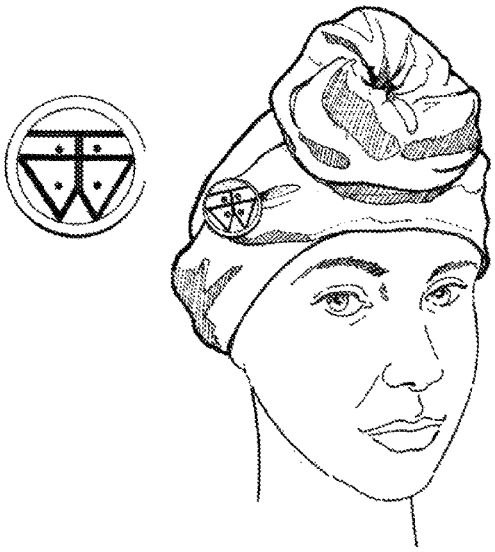
FIG. 30*c* illustrates a button attachment that can be added in exchange for the button attachment (19*a, b, c, d*)
Figure 30D:
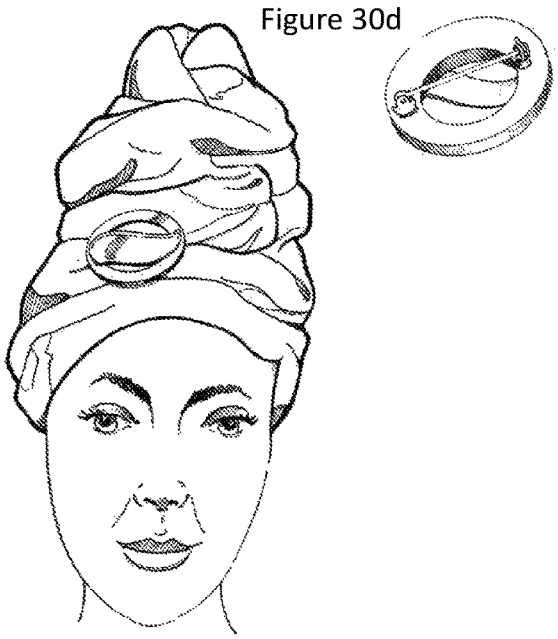
FIG. 30*d* illustrates a pin attachment that can be worn in any place on the wrap cap.

FIGS. 30*a-d* illustrate the hair wrap with decorative ornament attachment means, herein shown as clip attachments. FIG. 30*a* illustrates a back view of the hair wrap with a clip attachment 3043. FIG. 30*b* illustrates the clip attachment of FIG. 30*a*. The clip attachment is attached to the pouch end loop. It can be used as a decoration when the wrap cap is undone. The clip attachment, for example, is contemplated to be worn on the end of the pouch when wearing a helmet, such as a bicyclist or motorcyclist. FIG. 30*c* illustrates a button attachment that can be added in exchange for the button attachment (19*a, b, c, d*). FIG. 30*d* illustrates a pin attachment that can be worn in any place on the wrap cap. The pin can be used to hold the twist in place in a particular style. Meaning one can be very creative with designing a warp cap style and using the pin as an anchor. The attachments can be worn on all four wrap cap lengths (short, medium, long and/or extra long). The attachments can have logos or designs on them and can be offered in a variety of styles using wood, plastic, glass, metal, gold plated, crystals, rhinestones, beads, pearls, stones, jewels, rocks, molded designs etc. . . . Also monograms can be stitched on and stamped on which is a nice way to be done for bridal party wear, hotel wear, salon wear customization.

Figure 31A:
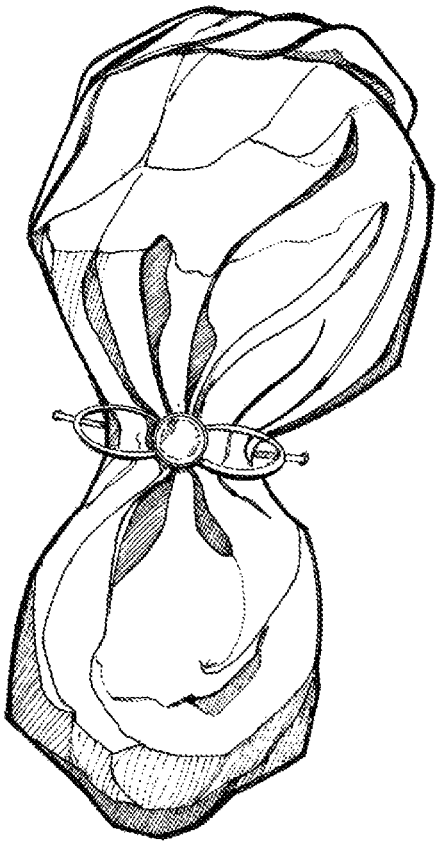
FIG. 31*a* illustrate a shows a back view of the hair wrap with an attachment attached.
Figure 31B:
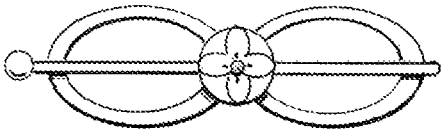
FIG. 31*b* illustrates a top view of an embodiment of the flex stick attachment.
Figure 31C:
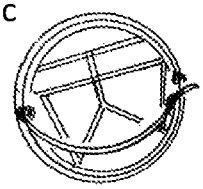
FIG. 31*c* illustrates a back view of an embodiment of the flex buckle attachment.
Figure 31D:
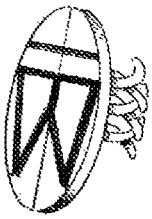
FIG. 31*d* illustrates a side view of an embodiment of the flex attachment, showing a clamp attachment.
Figure 31E:
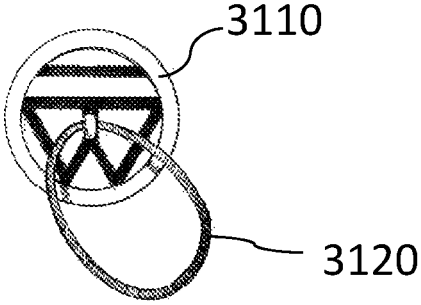
FIG. 31*e* illustrates a back view of an embodiment of the flex elastic attachment.

FIGS. 31*a-e* illustrate the hair wrap with flex stick attachments. FIG. 31*a* shows a back view of the hair wrap with an attachment attached. FIG. 31*b* illustrates a top view of an embodiment of the flex stick attachment. The attachment FIG. 31*e* includes a front face 3110 attached to a back-elastic loop 3120. Flex stick attachment can be worn around the pouch at the base by the neck. In a forward position, when the ties are tied and tucked around the head and the pouch is undone or pouch is lifted and fastened underneath itself on the pouch mouth base button. The flex stick attachment can be added. It works well when wearing a helmet or hat. FIGS. 31*c* illustrates a back view of an embodiment of the flex buckle attachment. A buckle attachment is show. It can be used by buckling around the ties either when the ties are tucked or knotted. Also, buckled around the ties, if they are left undone. So, if the pouch is undone the ties can go on top of the pouch and the buckle is used to hold the ties in place. FIG. 31*d* illustrates a side view of an embodiment of the flex attachment, showing a clamp attachment. The clamp attachment can easily be worn by clamping on any place on the wrap cap. This attachment has the versatility as the pin attachment. However the clamp can also be used on the pouch end elastic loop. FIG. 31*e* illustrates a back view of an embodiment of the flex elastic attachment. The elastic attachment is a special way the crown band or elastic band can be gathered up with and elastic wrapped around a band or both bands. The elastic attached to the attachment is then slipped under a tucked tie back around tie and fastened on the attachment to hold gathered bands in place. This design works on the small pouch because the lack of length of material so the wearer can create more design to the wrap cap. However, this elastic attachment could best be used if the head hair wrap cap was designed as a bridal head piece. Then tulle, satin or silk material could be used instead of the bands for a more decorative bridal style. The head hair wrap cap would also be designed with an exterior silk or satin material to match. The many variety of attachments are a way that a brand can be applied and/or to apply individuality to the wrap wearer to add personalized style.

Figure 32A:
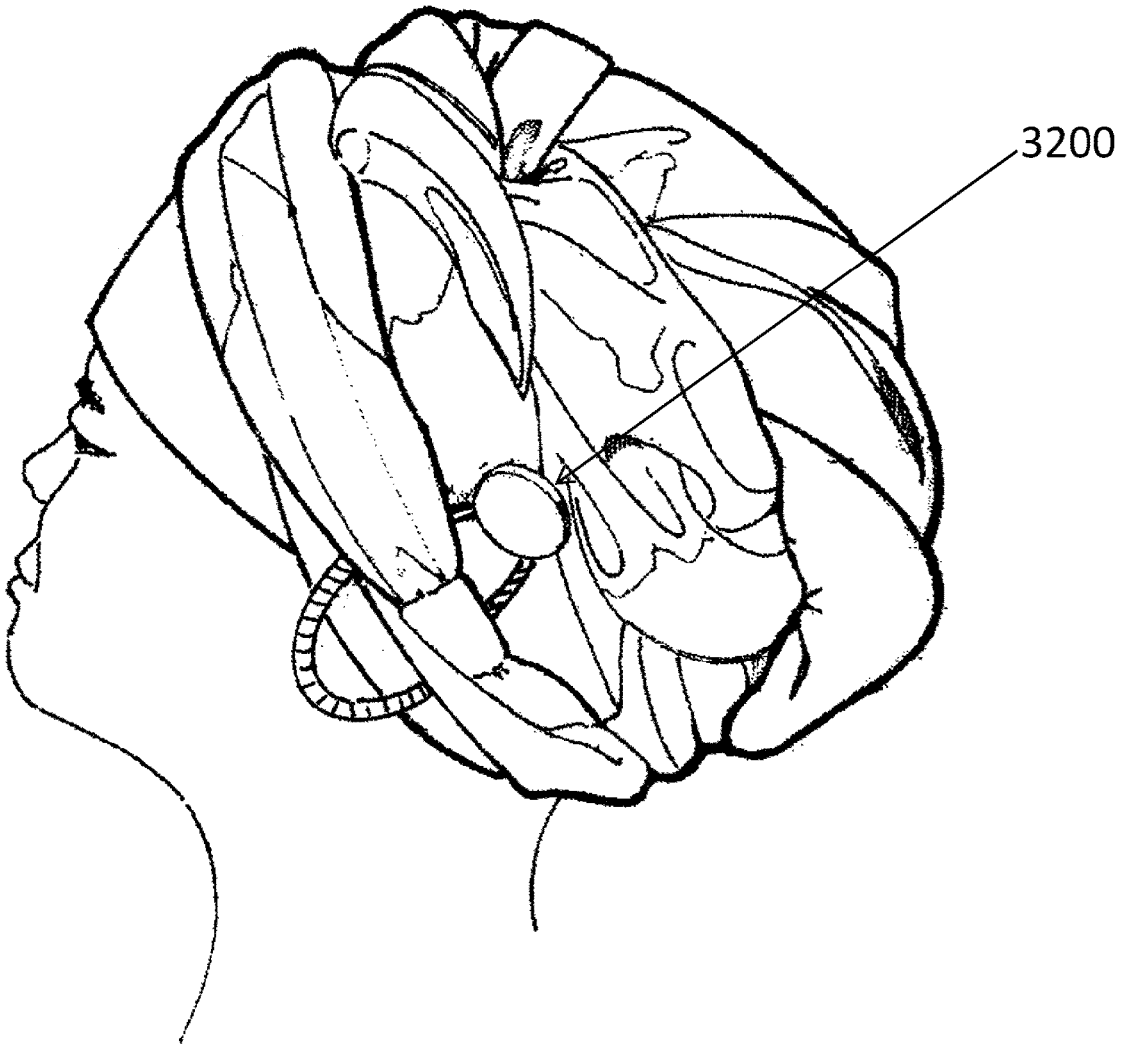
FIG. 32*a* illustrates a side view of a hair wrap with the flexible elastic attachment of FIG. 31*e;*
Figure 32B:
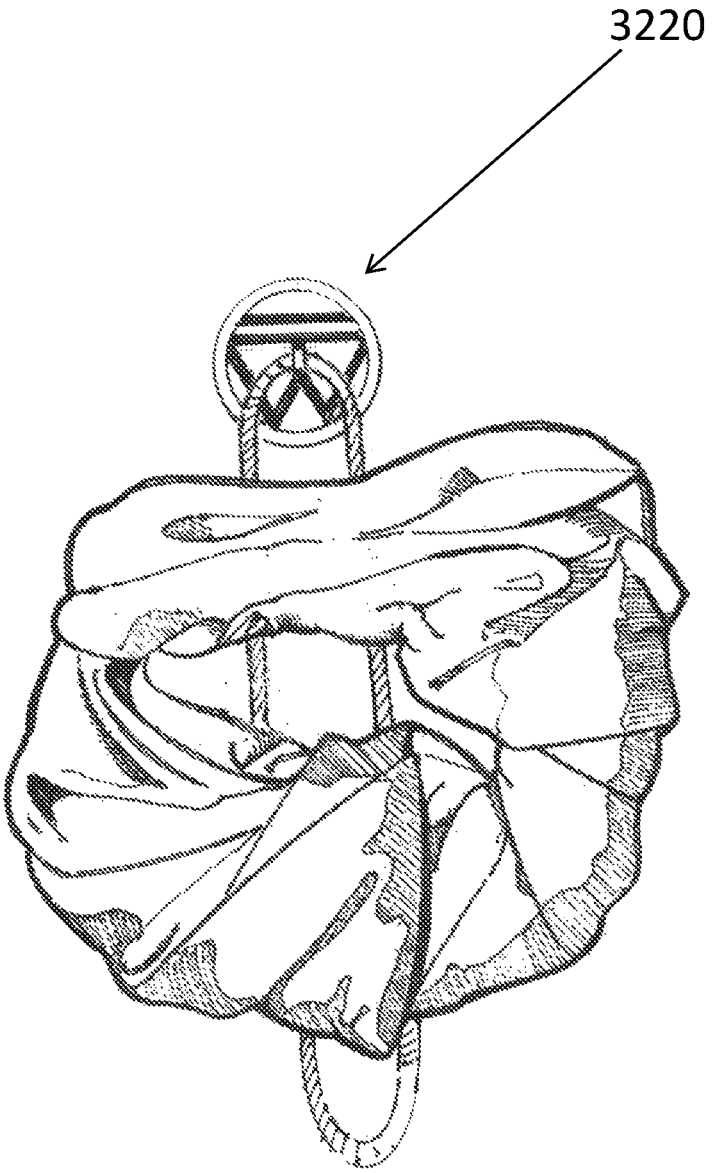
FIG. 32*b* illustrates an elastic band with the flexible attachment of FIG. 31*e*.
Figure 32C:
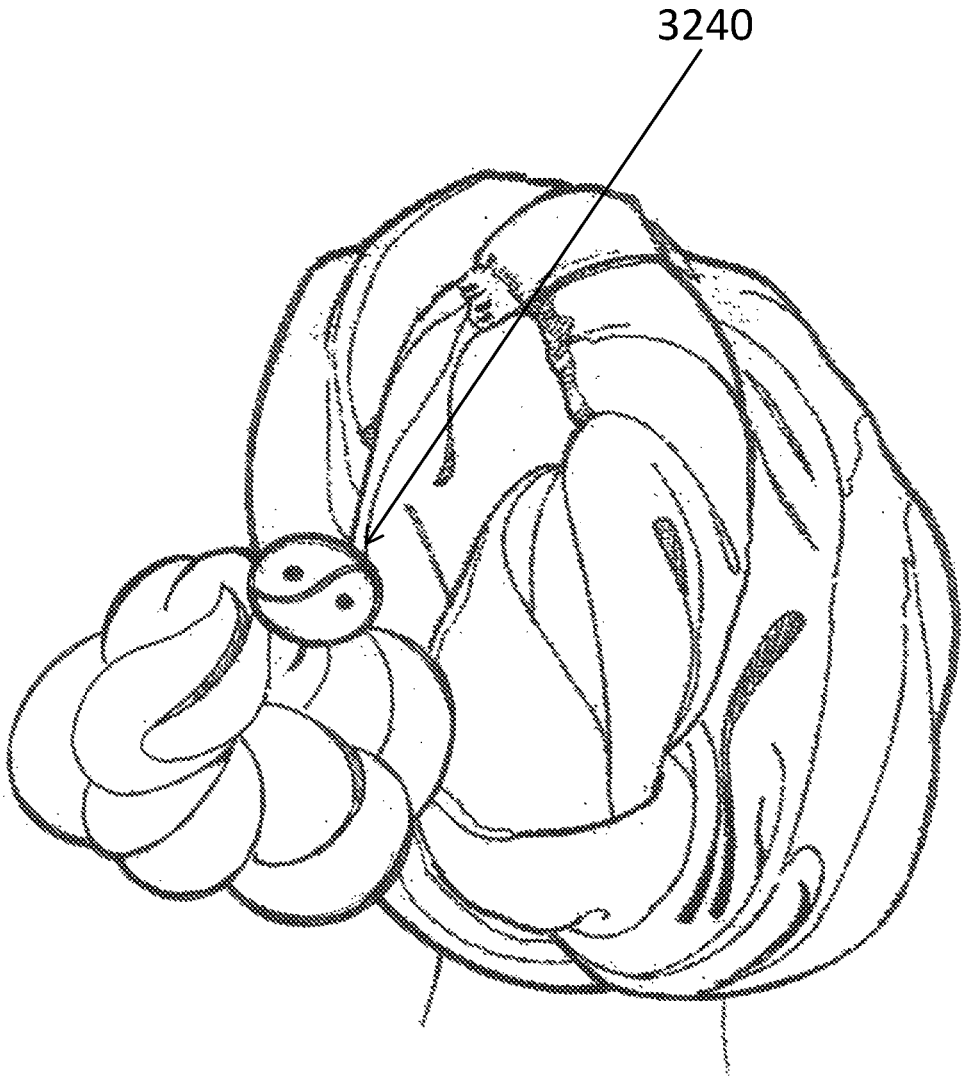
FIG. 32*c* illustrates a hair wrap with the flexible attachment of FIG. 31*e.*

FIG. 32*a-c* illustrate images of the flex elastic attachment of FIG. 31*e* used on the hair wrap. FIG. 32*a* illustrates a side view of a hair wrap with the flexible elastic attachment of FIG. 31*e* attached at 3200. The elastic could simply be lifted up over the logo round shape for closure. FIG. 32*b* illustrates an elastic band with the flexible attachment of FIG. 31*e*, shown at 3220. FIG. 32*c* illustrates a hair wrap with the flexible attachment of FIG. 31*e* attached at 3240.

Alternative features of the subject invention are contemplated and non-limiting including, for example: the hair wrap may be constructed in a plethora of colors and designs; sizes; and lengths; etc. These features are contemplated in combination with the main embodiments shown in the Figures.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A hair wrap for enveloping hair, comprising:

a. a main body having an exterior surface and an interior surface and having a top section forming a cap portion with a perimeter rim extending along said cap portion, said top section extending into at least two elongated side walls forming a bottom section extending from said top section, an interior wall attached at edges of said perimeter rim and said at least two elongated side walls forming an elongated pouch and a pouch mouth opening comprising a central section located along said interior wall, said pouch mouth opening extending between and attached to opposite ends of said perimeter rim of said top section, said perimeter rim terminating at and abutting edges of said pouch mouth opening;

b. at least two elongated ties located on opposite sides of said at least two elongated side walls, said at least two elongated ties being connected to one another with a central seam under the pouch mouth opening and attached directly to said perimeter rim and said pouch mouth opening, said at least two elongated ties being located along said central section of said pouch mouth opening and being adapted to secure said hair wrap on said user's head and mitigate water entry;

c. a pouch attachment located on a bottom edge of said pouch;

d. a cap portion attachment and crown material loop located on said top section, said pouch attachment adapted to mate with said cap portion attachment and said crown material loop being adapted to hold said pouch after said pouch is twisted and lifted toward said top section;

whereby said pouch is adapted to lay untwisted when said hair wrap is in an extended position and to be twisted and lifted toward said top section to rest upon said cap portion and be secured with said cap portion attachment when said hair wrap is in a wrapped position.

2. The hair wrap as recited by claim 1, wherein said interior surface is substantially lined with an absorbent material.

3. The hair wrap as recited by claim 1, wherein said interior surface is substantially lined with a material that can be heated or chilled to regulate body temperature.

4. The hair wrap as recited by claim 1, wherein said exterior surface is composed of a water repellant or water impermeable material.

5. The hair wrap as recited by claim 1, wherein said at least two elongated ties comprise a proximal section, a substantially central knuckle or seam, a distal section and a distal end, wherein a foam insert is located between said central knuckle or seam and said distal section, wherein said foam insert terminates to a malleable u-shaped or looped wire located within said distal end.

6. The hair wrap as recited by claim 5, wherein an absorptive material is located along said proximal section.

7. The hair wrap as recited by claim 1, wherein said perimeter rim is a flat material piece formed as an arch or curve.

8. The hair wrap as recited by claim 1, wherein said perimeter rim adjoins to ends of said pouch mouth opening and abuts said at least two elongated ties, said at least two elongated ties being adapted to fall to sides of a user's ears, said at least two elongated ties being adapted to be pulled down and secured or down and around then up over a user's head, said at least two elongated ties being adapted to be twisted in front of said top section for securing said hair wrap on said user's head and mitigating water entry when worn in a forward or tied in reverse when worn in a backwards position.

9. The hair wrap as recited by claim 1, wherein said pouch mouth opening comprises an elastic band.

10. The hair wrap as recited by claim 1, wherein said exterior surface of said main body has a plurality of attachment means.

11. The hair wrap as recited by claim 1, wherein said pouch has a pouch length extending from said pouch mouth opening to said bottom edge of said pouch and wherein said pouch length ranging from about 1 inches to 36 inches.

12. The hair wrap as recited by claim 1, wherein said central section of said pouch mouth opening comprises an elastic edge, and wherein said at least two elongated ties are located along said elastic edge on said central section of said pouch mouth opening, wherein said at least two elongated ties are adapted to be lifted up around the head and secured in a forward position and in reverse in a backwards position.

13. The hair wrap as recited by claim 1 comprising at least one elastic band having a proximal end and distal end connected by way of a connection means, wherein said at least one elastic band is adapted to be placed over said elongated pouch of said hair wrap when said elongated pouch is twisted into a wrapped position.

14. The hair wrap as recited by claim 1 comprising a head band, wherein said head band comprises a foam piece, wherein said head band is adapted to be placed over said hair wrap when it is being worn.

15. The hair wrap as recited by claim 1 comprising at least one decorative ornament attachment means.

16. The hair wrap as recited by claim 1, wherein said perimeter rim and at least a top portion of said at least two elongate ties include an absorbent material.

17. The hair wrap as recited by claim 1, wherein said main body is composed of at least two separate materials wherein said interior surface is composed of a different material than said exterior surface.

18. The hair wrap as recited by claim 1, wherein said elongated pouch and said at least two elongated ties are formed by said central seam.

19. The hair wrap as recited by claim 1, wherein said at least two elongated ties each have a length ranging from about 4 to 26 inches.

20. The hair wrap as recited by claim 1, wherein said hair wrap is a swim hair wrap and is composed of a waterproof material having elastic properties.

* * * * *